US008500240B2

(12) United States Patent
Matsubara et al.

(10) Patent No.: US 8,500,240 B2
(45) Date of Patent: Aug. 6, 2013

(54) IMAGE FORMING APPARATUS, METHOD OF SUCTIONING LIQUID FROM NOZZLES OF RECORDING HEAD AND COMPUTER READABLE INFORMATION RECORDING MEDIUM

(75) Inventors: Mitsuya Matsubara, Kanagawa (JP); Akiyoshi Tanaka, Kanagawa (JP); Yoichi Ito, Tokyo (JP); Tomomi Katoh, Kanagawa (JP); Fumitaka Kikkawa, Kanagawa (JP); Soyoung Park, Kanagawa (JP); Kunihiro Yamanaka, Kanagawa (JP); Kazuki Suzuki, Kanagawa (JP); Kuniyori Takano, Kanagawa (JP); Honriku Jo, Kanagawa (JP); Yuji Tanaka, Kanagawa (JP); Satoshi Endoh, Saitama (JP)

(73) Assignee: Ricoh Company, Ltd., Tokyo (JP)

( * ) Notice: Subject to any disclaimer, the term of this patent is extended or adjusted under 35 U.S.C. 154(b) by 160 days.

(21) Appl. No.: 13/217,431

(22) Filed: Aug. 25, 2011

(65) Prior Publication Data

US 2012/0056932 A1 Mar. 8, 2012

(30) Foreign Application Priority Data

Sep. 3, 2010 (JP) ..... 2010-197230

(51) Int. Cl.
*B41J 2/165* (2006.01)

(52) U.S. Cl.
USPC ..... 347/35

(58) Field of Classification Search
USPC ..... 347/22, 29, 35
See application file for complete search history.

(56) References Cited

U.S. PATENT DOCUMENTS

| | | | | |
|---|---|---|---|---|
| 7,341,328 | B2 * | 3/2008 | Berry et al. | 347/29 |
| 7,556,371 | B2 * | 7/2009 | Silverbrook | 347/109 |
| 2010/0026758 | A1 | 2/2010 | Tanaka et al. | |
| 2010/0061745 | A1 | 3/2010 | Ito et al. | |
| 2010/0207990 | A1 | 8/2010 | Ito et al. | |
| 2011/0109692 | A1 | 5/2011 | Ito et al. | |
| 2011/0141181 | A1 | 6/2011 | Ito et al. | |

FOREIGN PATENT DOCUMENTS

| | | |
|---|---|---|
| JP | 2007-160793 | 6/2007 |
| JP | 2010-780 | 1/2010 |
| JP | 2010-120266 | 6/2010 |

* cited by examiner

*Primary Examiner* — Lamson Nguyen
(74) *Attorney, Agent, or Firm* — Cooper & Dunham LLP

(57) ABSTRACT

An image forming apparatus includes a recording head configured to have a nozzle face on which nozzles that discharge liquid droplets are formed; a cap configured to cap the nozzle face of the recording head; a discharge path configured to be connected to the cap; a suction pump configured to be provided in the discharge path and be made of a tube pump; and an atmosphere opening part configured to open an airtight space, created when the nozzle face is capped by the cap, to the atmosphere. The atmosphere opening part is configured to communicate with the inside of the cap at a position higher than a surface of liquid discharged into the cap, and a check valve configured to prevent a flow of the liquid toward the cap from the suction pump is provided in the discharge path.

6 Claims, 24 Drawing Sheets

IMAGE FORMING APPARATUS, METHOD OF SUCTIONING LIQUID FROM NOZZLES OF RECORDING HEAD AND COMPUTER READABLE INFORMATION RECORDING MEDIUM

BACKGROUND OF THE INVENTION

1. Field of the Invention

The present invention relates to an image forming apparatus, a method of suctioning liquid from nozzles of a recording head of the image forming apparatus and a computer readable information recording medium; and in particular, to an image forming apparatus having a recording head that discharges liquid droplets, a method of suctioning liquid from nozzles of the recording head of the image forming apparatus and a computer readable information recording medium storing a program for carrying out the method.

2. Description of the Related Art

An image forming apparatus can be, for example, a printer, a facsimile machine, a copier, a plotter, or a multi-function peripheral in which some functions of a printer, a facsimile machine, a copier, a plotter, and so forth, are combined. As such an image forming apparatus, an ink jet recording apparatus is known, for example. An ink jet recording apparatus is known as an image forming apparatus of a liquid discharge recording type using a recording head that is configured as a liquid discharge head (or a liquid droplet discharge head) that discharges ink droplets. In such an image forming apparatus of the liquid discharge recording type, ink droplets are discharged by a recording head onto a sheet of paper that has been conveyed, so that an image is formed on the sheet of paper. Forming an image may also be referred to as recording, printing or such. Image forming apparatuses of the liquid discharge recording type include a serial-type image forming apparatus and a line-type image forming apparatus. The serial-type image forming apparatus is such that a recording head moving in main scan directions discharges liquid droplets and forms an image. The line-type image forming apparatus is such that a line type recording head is used where the recording head not moving discharges liquid droplets and forms an image.

It is noted that in the present Patent Application, an "image forming apparatus" of the liquid discharge recording type means an apparatus that discharges liquid to a medium such as paper, thread, fiber, cloth, leather, metal, plastic, glass, wood, ceramics or such. "Forming an image" means not only giving to a medium an image that has a meaning such as a letter, a figure or such, but also giving to a medium an image that does not have a meaning such as a pattern or such (also means merely causing a liquid droplet to land on a medium). "Ink" means not only one called "ink", but is used as a general term for any thing that is capable of being used to form an image, such as one called recording liquid, fixing solution, liquid or resin. Further, "sheet of paper" is not limited to one made of a paper material, includes an OHP (Over Head Projector) sheet, cloth or such, has a meaning of one to which an ink droplet adheres, and is used as a general term for any thing including one called a to-be-recorded-on medium, a recording medium, recording paper, or such. Further, an "image" is not only a planar image but also an image given to a thing that has been formed three-dimensionally, or a statue or such having a three-dimensional shape formed as a result of being molded three-dimensionally or so.

In an image forming apparatus of the liquid discharge recording type, a maintenance and recovery mechanism may be provided for the purpose of maintaining stability in discharging liquid droplets from nozzles of a recording head, and preventing ink in the nozzles from being dried and preventing dirt/dust from entering the nozzles. The maintenance and recovery mechanism includes a cap that caps a nozzle face of the recording head, and a wiper member (which may be called a wiper blade, a wiping blade or a blade) that wipes and cleans the nozzle face of the recording head. For example, after the ink having increased viscosity is discharged from the nozzles into the cap, a recovery operation is carried out in which the nozzle face is wiped by the wiper member, and nozzle meniscuses are created.

As such a maintenance and recovery mechanism in the related art, one is known in which a suction pump made of a tube pump is provided in a discharge path that is used to discharge the ink from the cap (see Japanese Laid-Open Patent Application No. 2010-000780 (Patent Document 1)). In this maintenance and recovery mechanism, a driving force transmission mechanism is provided whereby a motor that is a single driving source carries out moving the cap and rotating the tube pump. In this maintenance and recovery mechanism, the suction pump is driven when the motor is rotated in a normal direction, and the cap is moved (raised and lowered) when the motor is rotated in a reverse direction.

As another example of such a maintenance and recovery mechanism in the related art, one is known in which an open/close valve is provided between a cap and a suction pump (see Japanese Laid-Open Patent Applications Nos. 2007-160793 and 2010-120266 (Patent Documents 2 and 3)).

SUMMARY OF THE INVENTION

According to an embodiment of the present invention, an image forming apparatus includes a recording head configured to have a nozzle face on which nozzles that discharge liquid droplets are formed; a cap configured to cap the nozzle face of the recording head; a discharge path configured to be connected to the cap; a suction pump configured to be provided in the discharge path and be made of a tube pump; and an atmosphere opening part configured to open an airtight space, created when the nozzle face is capped by the cap, to the atmosphere. The atmosphere opening part communicates with the inside of the cap at a position higher than a surface of liquid discharged into the cap. A check valve configured to prevent a flow of the liquid toward the cap from the suction pump is provided in the discharge path.

Other objects, features and advantages of the embodiment of the present invention will become more apparent from the following detailed description when read in conjunction with the accompanying drawings.

DETAILED DESCRIPTION OF THE EMBODIMENTS

Figure 1:
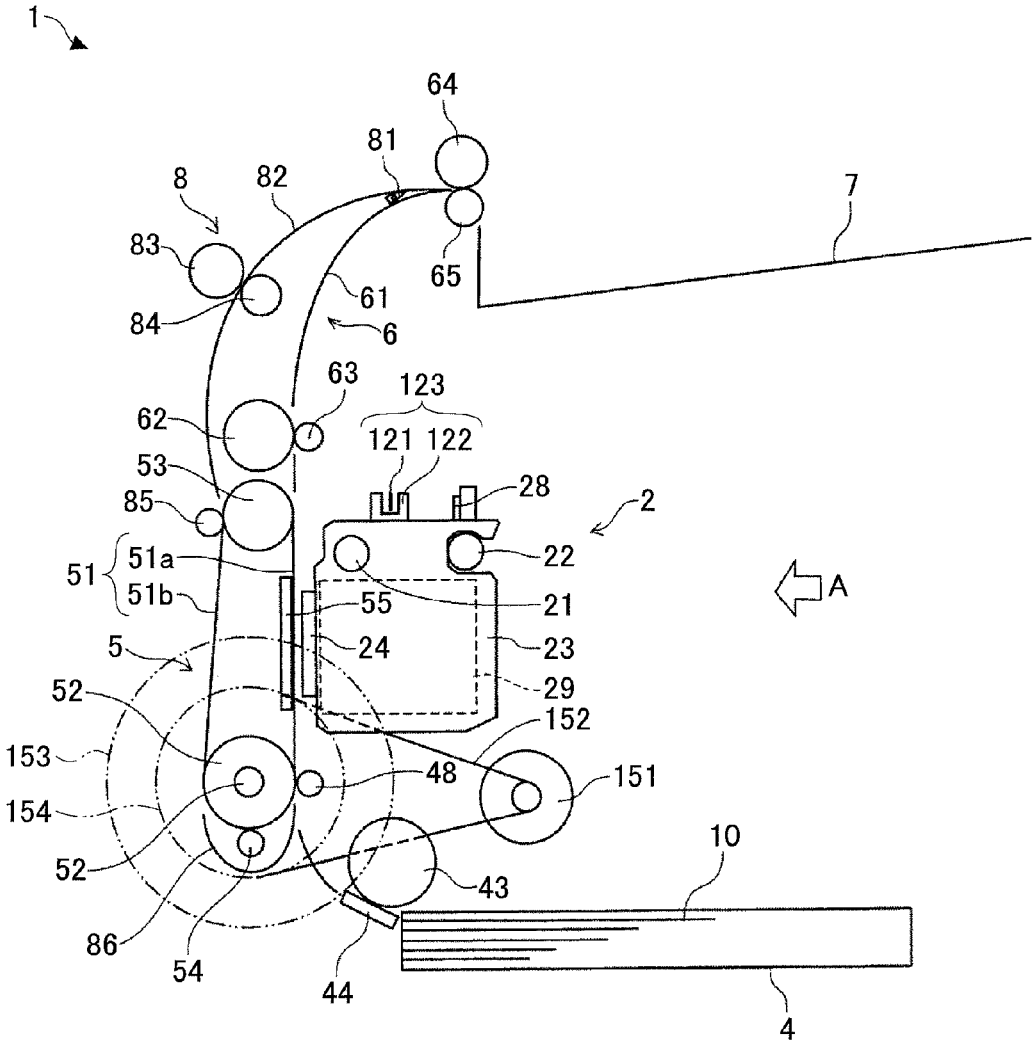
FIG. 1 generally shows a side view of an image forming apparatus according to any one of first and second embodiments of the present invention.

First, problems to be solved by the embodiments of the present invention will be described. In the above-mentioned maintenance and recovery mechanism discussed in Patent Document 1, when the cap is to be removed from the nozzle face, the cap is attracted to the nozzle face by suction, as a sucker, since the inside of the cap has negative pressure. Thereafter, the negative pressure in the airtight space in the cap is weakened so that the cap can be removed from the nozzle face.

For this purpose, such a configuration may be provided that in the tube pump, a roller that crushes and slides along a tube to push out liquid through the tube stops the crushing of the tube when the motor is rotated in the reverse direction. Thereby, the inside of the cap communicates with the atmosphere through the tube on a waste liquid discharge side, the negative pressure in the inside (airtight space) of the cap is weakened, and thus, the cap is easily removed from the nozzle face.

However, when the roller thus stops the crushing of the tube in the tube pump, a flow of air through the tube may occur from the waste water discharge side to the inside of the cap, and the air may thus enter the cap, whereby air bubbles may be generated in the cap.

If the air bubbles are thus generated and grow in the cap, the ink having been discharged from the nozzles and remaining in the cap may adhere to the nozzle face.

It is noted that a configuration of one image forming apparatus of the liquid discharge recording type may be as follows. A to-be-recorded-on medium (paper or such) is conveyed along a vertical direction or a direction inclined from the vertical direction, and a recording head that discharges liquid drops to the to-be-recorded-on medium in a horizontal direction or a direction inclined from the horizontal direction is moved in main scan directions. Thus, an image is formed on the to-be-recorded-on medium by the recording head. In the configuration, the recording head is provided to have a nozzle face on which are formed nozzles that discharge liquid droplets and which is disposed to extend along the vertical direction or the direction inclined from the vertical direction. Further, as mentioned above, the recording head discharges the liquid droplets in the horizontal direction or the direction inclined from the horizontal direction. A system having the configuration in which the to-be-recorded-on medium is conveyed in the vertical direction or the direction inclined from the vertical direction, and the liquid droplets are discharged to the to-be-recorded-on medium in the horizontal direction or the direction inclined from the horizontal direction, is called a "horizontal discharge system".

It is noted that, for example, the direction inclined from the horizontal direction may fall within an angle range between an oblique direction inclined 45° downward from the horizontal direction to an oblique direction inclined 45° upward from the horizontal direction, and any direction falling within the angle range (total 90°) may be referred to as a "horizontal direction". Similarly, the direction inclined from the vertical direction may fall within an angle range between an oblique direction inclined 45° to one side from the vertical direction to an oblique direction inclined 45° to the opposite side from the vertical direction, and any direction falling within the angle range (total 90°) may be referred to as a "vertical direction".

Further, a system in which a to-be-recorded-on medium is conveyed in the horizontal direction or the direction inclined from the horizontal direction, and liquid droplets are discharged to the to-be-recorded-on medium in the vertical direction or the direction inclined from the vertical direction is called a "vertical discharge system".

In an image forming apparatus of the horizontal discharge system, a case may be assumed where one recording head having plural nozzle rows that discharge liquid droplets of different colors is used. In this case, the ink discharged to the cap from the plural nozzle rows of the recording head is in a state where the different colors are mixed. Then, if air bubbles are generated in the cap as mentioned above, the ink in the color mixture state may adhere to the nozzle face of the recording head, and may enter the nozzles. Thereby, an image formed by the recording head onto a to-be-recorded-on medium may be degraded due to the color mixture.

The embodiments of the present invention have been devised in consideration of the problem, and an object of the embodiments of the present invention is to prevent the air bubbles from being generated in the cap even when the negative pressure in the cap is weakened, and to prevent the color mixture or such due to the air bubbles from occurring.

Figure 2:
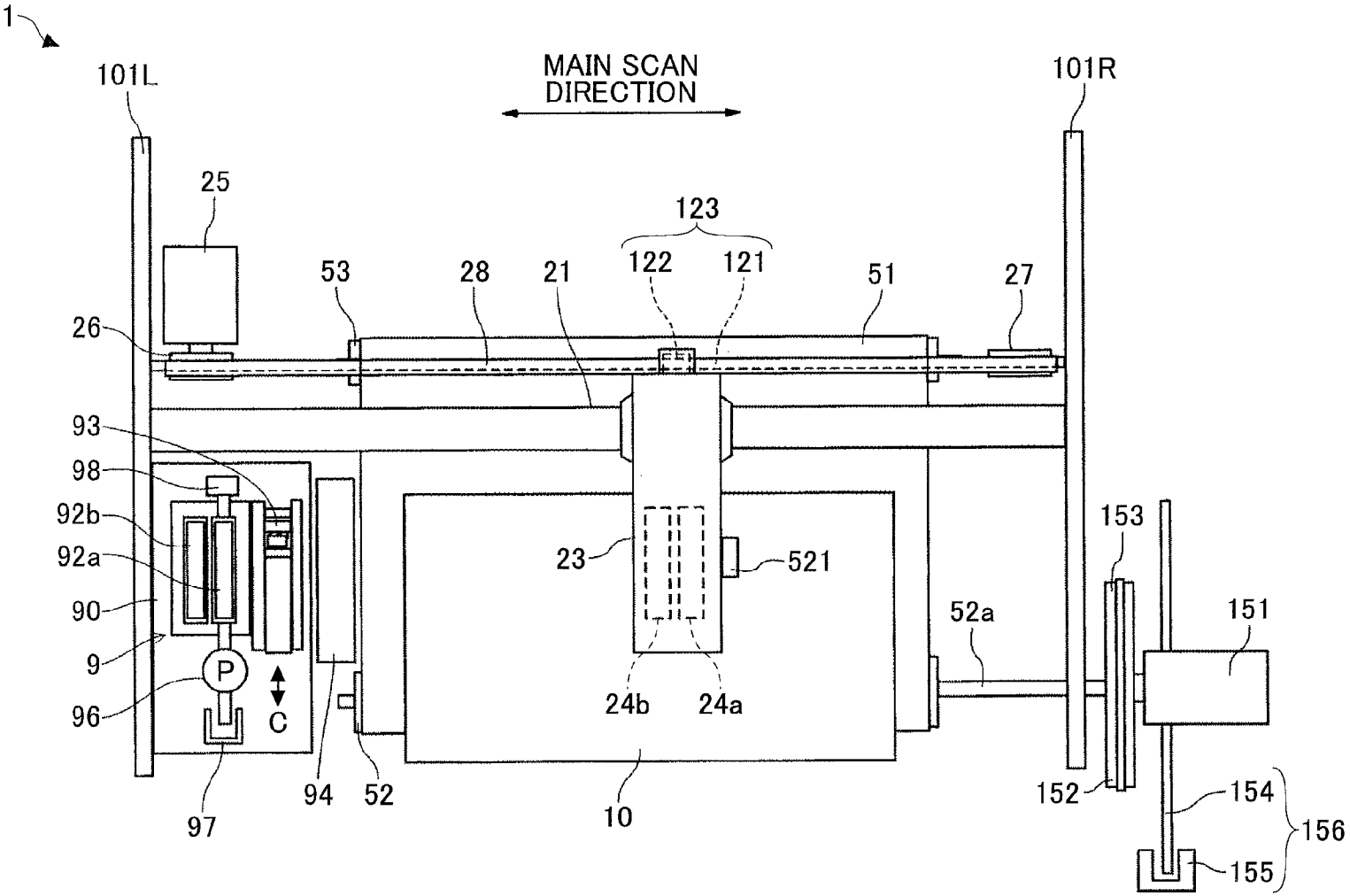
FIG. 2 generally shows a view of the image forming apparatus shown in FIG. 1 taken from a direction of an arrow A shown in FIG. 1.

Below, the embodiments of the present invention will be described with reference to figures. First, an image forming apparatus 1 according to any one of first and second embodiments of the present invention will be described with reference to FIGS. 1 and 2. FIG. 1 generally shows a side view of the image forming apparatus 1 and FIG. 2 generally shows a view of the image forming apparatus 1 of FIG. 1 taken from a direction of an arrow A shown in FIG. 1.

The image forming apparatus 1 is a serial-type image forming apparatus, and has, in the inside of a body of the image forming apparatus 1, an image forming part 2, a conveyance mechanism 5, and so forth. At a bottom side of the body of the image forming apparatus 1 is provided a paper supply tray (acting as a paper supply part and including a paper supply cassette) 4, on which sheets of paper 10 that are to-be-recorded-on media are stacked. In the image forming apparatus 1, the sheets of paper 10 are taken off from the paper supply tray 4, sheet by sheet, and the taken-off sheet of paper 10 is intermittently conveyed by the conveyance mechanism 5 vertically (upward). While the sheet of paper 10 is thus conveyed, the image forming part 2 horizontally discharges liquid droplets to the sheet of paper 10, and thus, forms a desired image on the sheet of paper 10. After that, a paper ejection part 6 conveys further upward the sheet of paper on which the image is thus formed, and thus, the sheet of paper 10 is ejected to a paper ejection tray 7 provided at a top side of the body of the image forming apparatus 1.

When duplex printing is carried out, the following operations are carried out in the image forming apparatus 1. After the printing of the desired image on one side (front side) of the sheet of paper 10 is thus finished, the sheet of paper 10 is taken off from the paper ejection part 6 into a reversal part 8. Then, the conveyance mechanism 5 conveys the sheet of paper 10 in the opposite direction (downward) and is reversed. Then, the sheet of paper 10 is caused to have such a state that printing on the other side (back side) can be carried out, and is conveyed by the conveyance mechanism 5 upward. Then, printing on the other side of the sheet of paper 10 is carried out by the image forming part 2, and after that, the sheet of paper 10 on which the duplex printing is thus carried out is ejected to the paper ejection tray 7.

In the image forming part 2, a main guide member 21 and an auxiliary guide member 22, both extending horizontally, are supported by right and left side plates 101L and 101R. A carriage 23 carrying recording heads 24*a* and 24*b* (which may be generally referred to as "recording heads 24" when the recording heads 24*a* and 24*b* are not distinguished therebetween) is supported slidably by the main guide member 21 and the auxiliary guide member 22. A main scan motor 25 moves the carriage 23 in main scan directions via a timing belt 28 that is wound between a driving pulley 26 and a driven pulley 27. Thus, the carriage 23 carries out scanning operations.

On the carriage 23, the recording heads 24*a* and 24*b* are disposed. The recording heads 24 have liquid discharging heads that discharge ink droplets of respective colors, i.e., yellow (Y), magenta (M), a cyan (C) and black (K). The recording heads 24 are disposed on the carriage 23 in such a manner that each nozzle row of plural nozzles formed on the nozzle face of the recording head 24 is arranged along a sub-scan direction that is perpendicular to the main scan directions (see FIG. 2). In the configuration, a direction in which the recording heads 24 discharge the ink droplets is a horizontal direction. That is, the image forming apparatus 1 according to any one of the first and second embodiments of the present invention is of the horizontal discharge system having the recording heads 24 in which the nozzle faces, on which the nozzles discharging the liquid droplets (i.e., the ink droplets) are formed, are disposed to extend along a vertical direction. Thus, the recording heads 24 discharge the liquid droplets in the horizontal direction.

Figure 3:
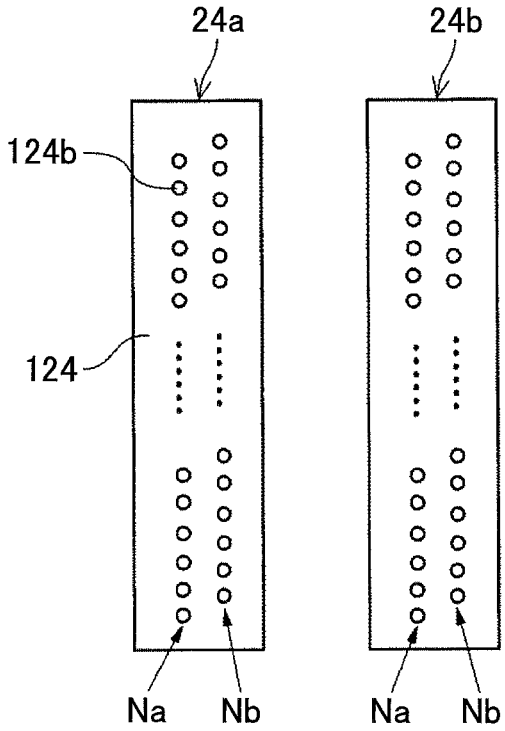
FIG. 3 illustrates recording heads shown in FIGS. 1 and 2.

As shown in FIG. 3, each of the recording heads 24 has two nozzle rows Na and Nb in each of which plural nozzles 124*b* that discharge liquid drops are arranged. One (Na) of the two nozzle rows of the recording head 24*a* discharge yellow (Y) liquid drops, and the other Nb (of) the two nozzle rows of the recording head 24*a* discharge magenta (M) liquid drops. One (Na) of the two nozzle rows of the recording head 24*b* discharge black (K) liquid drops, and the other (Nb) of the two nozzle rows of the recording head 24*b* discharge cyan (C) liquid drops.

It is noted that in the recording heads 24, it is possible to use liquid discharge heads that include, as pressure generation parts that generate pressure for discharging liquid droplets, piezoelectric actuators such as piezoelectric elements, thermal actuators using electrothermal elements such as heat elements and using phase change of liquid caused by film boiling, shape memory alloy actuators using metal phase change caused by temperature change, electrostatic actuators using electrostatic force, or such. Further, also a liquid discharge head that discharges a fixing solution for improving fixing performance of the ink by reacting to the ink may be provided to the carriage 23.

Further, head tanks 29, which correspond to the respective nozzle rows Na and Nb of the recording heads 24 and supply the ink of the corresponding colors, are loaded in the carriage 23. The ink is supplied to the head tanks 29 from respective ink cartridges (i.e., main tanks 11, described later with reference to FIG. 4) of the respective colors, detachably loaded in the body of the image forming apparatus 1.

Further, an encoder scale 121 in which a predetermined pattern is formed is provided between the side plates 101L and 101R along the main scan directions of the carriage 23. An encoder sensor 122 made of a transmission photo-sensor that reads the predetermined pattern of the encoder scale 121 is provided to the carriage 23. A linear encoder (i.e., a main scan encoder) 123 includes the encoder scale 121 and the encoder sensor 122, and detects a movement of the carriage 23.

Further, at a non-printing area at one side of the main scan directions of the carriage 23, a maintenance and recovery mechanism 9 used for maintaining and recovering states of the nozzles 124*b* of the recording heads 24 is disposed. In the maintenance and recovery mechanism 9, a suction cap 92*a* and a cap 92*b* (which may be generally referred to as "caps 92" when the caps 92*a* and 92*b* are not distinguished therebetween) and a wiper member (wiper blade) 93 are held by a frame 90. The caps 92 are used to cap respective nozzle faces 124 (see FIG. 3) of the recording heads 24. The wiper member 93 is used to wipe the nozzle faces 124 while it is being moved along directions C. Further, a dummy discharge receiver 94 that receives liquid droplets discharged when a preliminary discharge (dummy discharge) operation is carried out is provided in the maintenance and recovery mechanism 9. It is noted that the preliminary discharge (dummy discharge) operation is an operation in which liquid droplets not contributing to recording (printing) are discharged for the purpose of discharging ink having increased viscosity (or thick ink). To the suction cap 92*a*, a suction pump 96 made of a tube pump and acting as a suction part is connected via a check valve 196 (described later). The suction pump 96 communicates with a waste liquid tank 97. Further, to the suction cap 92*a*, an atmosphere opening valve 98 for opening an airtight space to the atmosphere is provided. The airtight space is formed when the nozzle face 124 of the recording head 24 is capped by the suction cap 92*a*.

Each of the sheets of paper 10 stacked on the paper supply tray 4 is separated by a paper supply roller (semicircular roller) 43 and a separation pad 44, sheet by sheet, and is supplied to the inside of the body of the image forming apparatus 1. Then, the sheet of paper 10 is fed into between a conveyance belt 51 and a pressing roller 48 of the conveyance mechanism 5 along conveyance guide members (not shown), and is attracted to and conveyed by the conveyance belt 51.

The conveyance mechanism 5 has the endless conveyance belt 51 wound between a conveyance roller (driving roller) 52 and a driven roller 53; an electrification roller 54 that electrifies the conveyance belt 51; and a platen member 55 that maintains planarity of the conveyance belt 51 at a part that faces the image forming part 2.

The conveyance belt 51 is rotated and moved in a belt conveyance direction (i.e., a sub-scan direction or a paper conveyance direction) as a result of the conveyance roller 52 being driven and rotated by a sub-scan motor 151 via a timing belt 152 and a timing pulley 153. An area of the conveyance belt 51 extending from the conveyance roller 52 to the driven roller 53, facing the image forming part 2 and attracting the sheet of paper 10, is referred to as a regular conveyance part 51*a*. An area of the conveyance belt 51 extending from the driven roller 53 to the conveyance roller 52, opposite to the regular conveyance part 51*a*, is referred to as a reversal conveyance part 51*b*.

Further, a code wheel 154 on which a pattern is formed is mounted to a shaft 52*a* of the conveyance roller 52. Further, an encoder sensor 155 made of a transmission photo-sensor, reading the pattern formed on the code wheel 154, is provided. A rotary encoder (i.e., a sub-scan encoder) 156 includes the code wheel 154 and the encoder sensor 155, and detects a movement amount and a movement position of the conveyance belt 51.

A paper ejection guide member 61; paper ejection conveyance roller 62 and spur 63; and paper ejection roller 64 and spur 65 are disposed in the paper ejection part 6. The sheet of paper 10 on which an image is formed is ejected facedown to the paper ejection tray 7 from between the paper ejection roller 64 and spur 65.

The reversal part 8 reverses, in a switchback manner, the sheet of paper 10 a part of which has been once ejected to the paper ejection tray 7, and feeds it between the conveyance belt 51 and the pressing roller 48. For this purpose, the reversal part 8 has a switching claw 81, a reversal guide member 82, reversal roller 83 and spur 84, a driven auxiliary roller 85, the reversal conveyance part 51*b* of the conveyance belt 51, and a roundabout guide member 86. The switching claw 81 switches the paper ejection path and the reversal path. The driven auxiliary roller 85 faces the driven roller 53. The roundabout guide member 86 causes the sheet of paper 10, separated from the reversal conveyance part 51*b* of the conveyance belt 51, to make a detour to avoid the electrification roller 54 and guides the sheet of paper 10 between the conveyance belt 51 and the pressing roller 48.

In the image forming apparatus 1 configured as described above, the sheets of paper 10 stacked on the paper supply tray 4 are separated and supplied, sheet by sheet. Then, the sheet of paper 10 is electrostatically attracted by the electrified conveyance belt 51. The sheet of paper 10 is then conveyed vertically (upward) through the regular conveyance part 51*a* as a result of the conveyance belt 51 being rotated and moved. Then, the recording heads 24 are driven according to an image signal while the carriage 23 is moved in one of the main scan directions. Thus, one line of an image is recorded on the sheet of paper 10 that is in a stopped state, as a result of the recording heads 24 discharging ink droplets. Then, the sheet of paper 10 is conveyed a predetermined amount corresponding to one line, and after that the subsequent line of the image is recorded on the sheet of paper 10. The sheet of paper 10 on which recording of the image is thus finished is ejected onto the paper ejection tray 7 by the paper ejection part 6.

When maintenance and recovery operations for the nozzles of the recording heads 24 are to be carried out, the carriage 23 is moved to a position (i.e., a home position) at which the carriage 23 faces the maintenance and recovery mechanism 9. Then, the maintenance and recovery operations are carried out. The maintenance and recovery operations include a nozzle suction operation in which the suction cap 92*a* is used to cap the nozzle face 124 and the ink is suctioned from the nozzles 124*b* and discharged into the suction cap 92*a;* and a dummy discharge operation in which ink droplets not contributing for image forming (recording or printing) are discharged from the nozzles 124*b*. By thus carrying out the maintenance and recovery operations, the recording heads 24 can carry out image forming (i.e., printing or recording) operations by stably discharging liquid droplets.

When duplex printing is carried out, the above-described operations for forming an image on the sheet of paper 10 are carried out for printing an image on a first side of the sheet of paper 10. After that, when the trailing edge of the sheet of paper 10 has passed through a reversal part branch (i.e., the switching claw 81), the paper ejection roller 64 is driven in reverse. Thereby, the sheet of paper 10 is moved in the opposite direction in a switched back manner, and is guided by the reversal guide member 82. Then, the sheet of paper 10 is conveyed between the reversal roller 83 and spur 84. Then, the sheet of paper 10 is fed between the reversal conveyance part 51*b* of the conveyance belt 51 and the conveyance auxiliary roller 85.

Then, the sheet of paper 10 is attracted by the conveyance belt 51 at the reversal conveyance part 51*b*, and is conveyed downward through the reversal conveyance part 51*b* as the conveyance belt 51 is rotated and moved. Then, the sheet of paper 10 is separated from the conveyance belt 51 at the conveyance roller 52, and is then guided by the roundabout guide member 86 (and passes through a roundabout path). Thus, the sheet of paper 10 is again fed between the regular conveyance part 51*a* of the conveyance belt 51 and the pressing roller 48, and is attracted by the conveyance belt 51 at the regular conveyance part 51*a*. Then, the sheet of paper 10 is again conveyed upward into the image forming area at which an image is formed onto the sheet of paper 10 by the recording heads 24. Thus, printing onto the second side of the sheet of paper 10 is carried out, and after that, the sheet of paper 10 is ejected onto the paper ejection tray 7.

It is noted that the electrification roller 54 is disposed in the inside of the roundabout path (i.e., in the inside of the roundabout guide member 86) which is used when the second side of the sheet of paper 10 is to be carried out. Therefore, the sheet of paper 10 is attracted to the conveyance belt 51 that is at any time in the newly electrified state.

Figure 4:
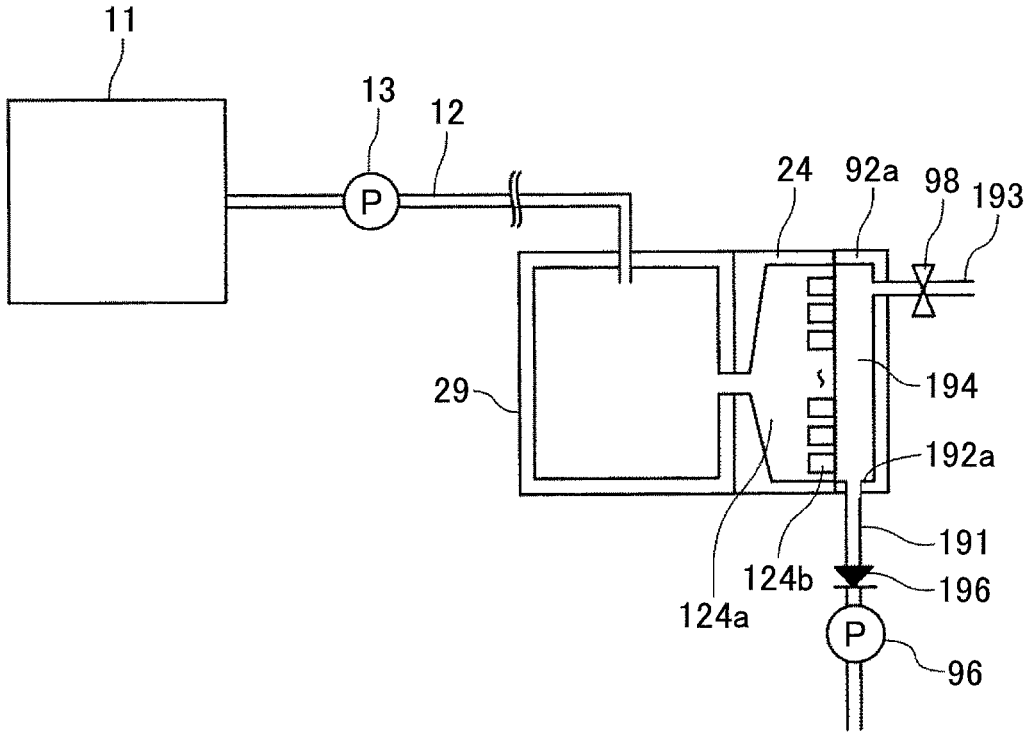
FIG. 4 schematically illustrates an ink supply and discharge system included in the image forming apparatus according to the first embodiment of the present invention.

Next, with reference to FIG. 4, schematically illustrating the ink supply and discharge system of the image forming apparatus 1 according to the first embodiment of the present invention, the ink supply and discharge system will be described.

The main tank (ink cartridge) 11 is detachably loaded in the body of the image forming apparatus 1 and holds the ink to be used by being discharged by the recording head 24. The main tank 11 and the head tank 29 are connected via a supply tube (supply path) 12, and a supply pump 13 made of a reversible pump is provided in the supply path 12. The supply pump 13 supplies the ink from the main tank 11 to the head tank 29 when running in a normal direction. The supply pump 13 returns the ink from the head tank 29 to the main tank when running in a reverse direction.

The recording head 24 and the head tank 29 are connected via a filter unit (not shown). The ink supplied from the main tank 11 is then supplied to a common liquid chamber 124*a* of the recording head 24. The ink is then supplied from the common liquid chamber 124*a* to an individual liquid chamber (not shown). The ink in the individual liquid chamber is pressurized and the ink droplet is discharged from the corresponding nozzle 124*b*. When the supply pump 13 is driven to run in the reverse direction and the ink is thereby returned from the head tank 29 to the main tank 11, negative pressure is generated in the head tank 29 accordingly.

The suction cap 92*a* that caps the nozzle face 124 of the recording head 24 is disposed to stand along the vertical direction to correspond to the recording head 24. The suction cap 92*a* is caused to go forward to and retreat from the recording head 24 by a cap moving mechanism (not shown). A discharge path 191 that communicates with the waste liquid tank 97 is connected to a bottom surface of the suction cap 92*a*. The suction pump 96 made of the tube pump is connected to the discharge path 191. The check valve 196 that prevents liquid from flowing toward the suction cap 92*a* from the suction pump 96 is provided between the suction cap 92*a* and the suction pump 96. Further, an atmosphere opening path 193 is provided at a top of the suction cap 92*a*, for communicating between an airtight space 194 created when the nozzle face 124 is capped by the suction cap 92*a* and the atmosphere. Further, the atmosphere opening valve 98 that opens and closes the atmosphere opening path 193 is provided.

Figure 5:
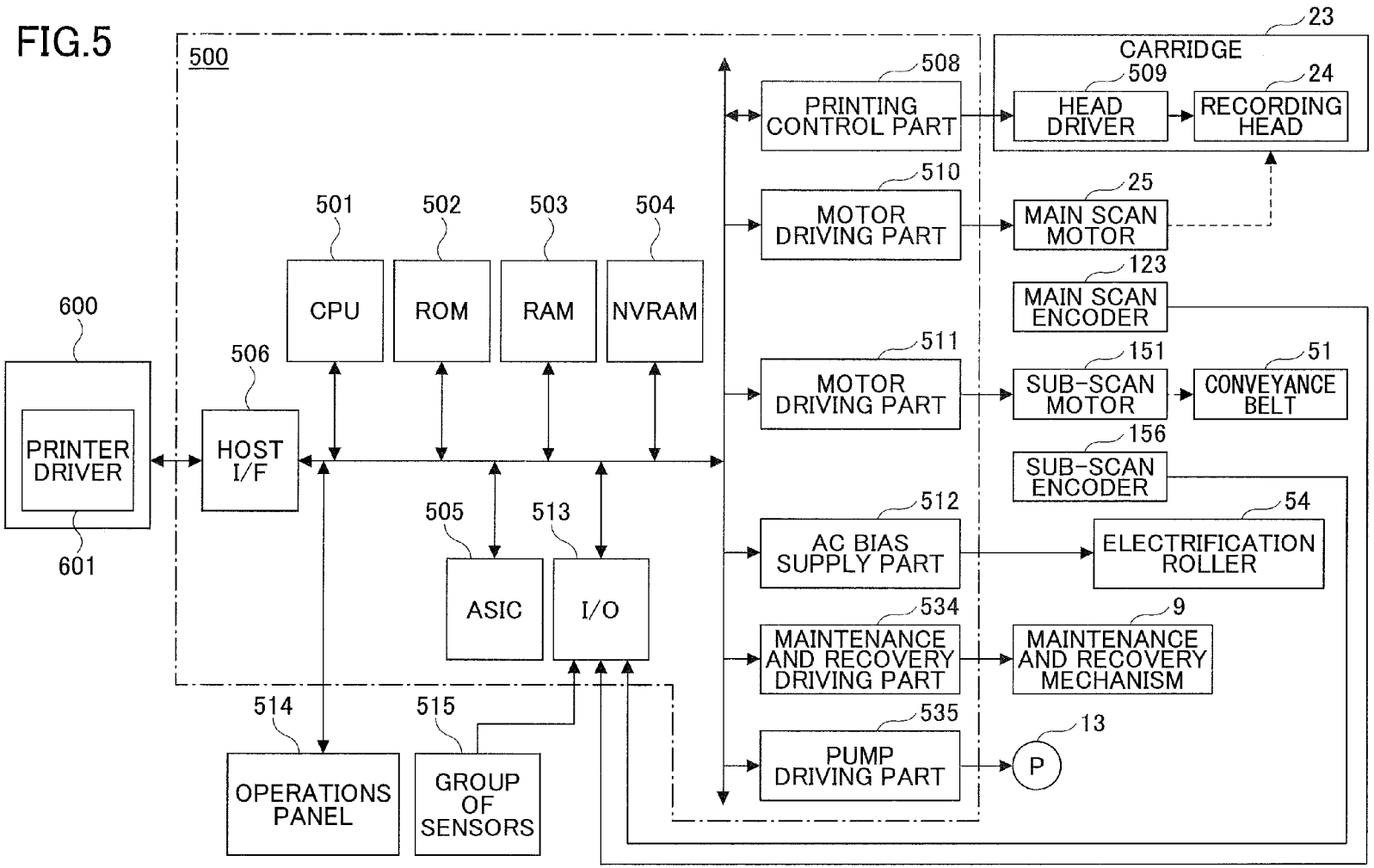
FIG. 5 shows a block configuration of a control part included in the image forming apparatus according to any one of the first, second, third and fourth embodiments of the present invention.

Next, an outline of a control part 500 of the image forming apparatus 1 will be described with reference to FIG. 5 that illustrates the control part 500.

The control part 500 includes a CPU (Central Processing Unit) 501, a ROM (Read Only Memory) 502, a RAM (Random Access Memory) 503, a rewritable non-volatile memory 504 and an ASIC (Application Specific Integrated Circuit) 505. The CPU 501 controls the entirety of the image forming apparatus 1. The ROM 502 stores various programs including a program or programs causing the CPU 501 to carry out the maintenance and recovery operations, and fixed data. The RAM 503 temporarily stores image data and so forth. The rewritable non-volatile memory 504 is capable of holding data even after the power supply to the image forming apparatus 1 is turned off. The ASIC 505 carries out various signal processing operations on image data, image processing of sorting the image data, and processing of input/output signals to be used for controlling the entirety of the image forming apparatus 1.

Further the control part 500 includes a printing control part 508, a head driver (driver IC (Integrated Circuit)) 509, motor driving parts 510 and 511 and an AC bias supply part 512. The printing control part 508 includes a data transfer part and a driving signal generation part (both not shown) for driving and controlling the recording heads 24. The head driver 509, provided to the carriage 23, drives the recording heads 24. The motor driving parts 510 and 511 drive the main scan motor 25 that moves the carriage 23 in the main scan directions and causes the carriage 23 to perform scanning operations, and the sub-scan motor 151 that rotates and moves the conveyance belt 51, respectively. The AC bias supply part 512 supplies an AC bias to the electrification roller 54.

Further, an operations panel 514 for the user to input necessary information to the image forming apparatus 1 and displaying necessary information to the user is connected to the control part 500.

The control part 500 has an I/F (InterFace) 506 used for transmitting and receiving data and signals to and from a host apparatus 600. The control part 500 receives various sorts of information by using the I/F 506 via a cable or a communication network from the host apparatus 600 such as an information processing apparatus such as a personal computer, an image reading apparatus such as an image scanner, an image pickup apparatus such as a digital camera, or such.

The CPU 501 of the control part 500 reads and analyzes printing data stored in a reception buffer (not shown) included in the I/F 506, carries out necessary image processing, data sorting processing and so forth with the ASIC 505, and transfers the image data to the head driver 509 from the printing control part 508. It is noted that generation of dot pattern data for outputting (or printing) an image is carried out by a printer driver 601 provided to the host apparatus 600.

To the head driver 509, the printing control part 508 transfers the above-described image data in a form of serial data, and outputs a transfer clock signal, a latch signal, a control signal, and so forth, necessary for transferring the image data, fixing the transfer, and so forth. Further, the printing control part 508 includes the driving signal generation part that includes a D-A (Digital to Analog) converter (not shown) that converts pattern data of driving pulses stored in the ROM 502, a voltage amplifier (not shown), a current amplifier (not shown), and so forth. The printing control part 508 outputs, to the head driver 509, a driving signal including one or plural driving pulses.

The head driver 509 drives the recording heads 24 by selectively applying the driving pulses included in the driving signal, given by the printing control part 508, to the driving elements (for example, the piezoelectric elements) of the recording heads, for generating energy to discharge liquid droplets, based on the serially input image data corresponding to one line of the recording heads 24. At this time, by selecting the driving pulses included in the driving signal, it is possible to discharge liquid droplets having different droplet sizes such as large droplets, medium droplets and small droplets, whereby it is possible to form dots on the sheet of paper 10 having different sizes.

An I/O part 513 included in the control part 500 obtains information from the main scan encoder 123, the sub-scan encoder 156 and a group of various sensors 515 mounted in the image forming apparatus 1, extracts necessary information for controlling the image forming apparatus 1, and uses the extracted information for controlling the printing control part 508, the motor driving parts 510, 511, and the AC bias supply part 512. The group of sensors 515 include an optical sensor (paper sensor) 521 (see FIG. 2) provided to the carriage 23 for detecting a position of the sheet of paper 10, a thermistor (not shown) used for monitoring the temperature and the humidity in the image forming apparatus 1, a sensor (not shown) used for monitoring the voltage of the electrification roller 54, an interlock switch (not shown) used for detecting whether a cover (not shown) of the image forming apparatus 1 is opened or closed, and so forth. The I/O part 513 is capable of processing various sorts of sensor information.

For example, the CPU 501 obtains a speed detection value and a position detection value obtained from sampling detection pulses provided by the encoder sensor 122 included in the main scan encoder 123. The CPU 501 calculates a driving output value (control value) to be given to the main scan motor 25 based on the thus-obtained speed detection value and position detection value, and also a speed target value and a position target value obtained from a previously stored speed and position profile. The CPU 501 uses the calculated driving output value to control the main scan motor 25 via the motor driving part 510. Similarly, the CPU 501 obtains a speed detection value and a position detection value obtained from sampling detection pulses provided by the encoder sensor 155 included in the sub-scan encoder 156. The CPU 501 calculates a driving output value (control value) to be given to the sub-scan motor 151 based on the thus-obtained speed detection value and position detection value, and also a speed target value and a position target value obtained from a previously stored speed and position profile. The CPU 501 uses the calculated driving output value to control the sub-scan motor 151 via the motor driving part 511.

Further, the control part 500 drives the maintenance and recovery mechanism 9 via a maintenance and recovery driving part 534, causes the caps 92 to go forward to and retreat from the nozzle faces 124 of the recording heads 24, moves the wiper member 94, and drives the suction pump 96. Further, the control part 500 drives the supply pump 13 (see FIG. 4) via a pump driving part 535.

Figure 6:
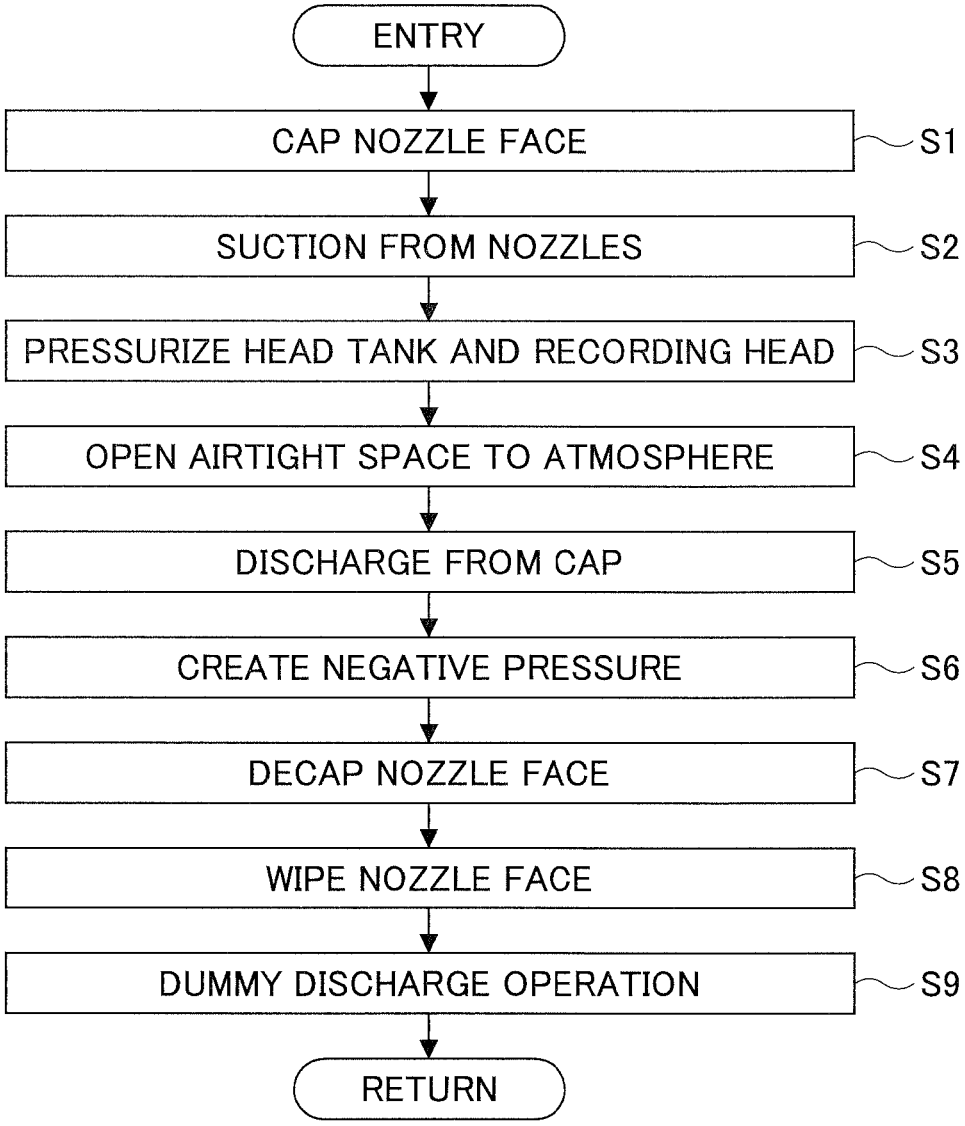
FIG. 6 shows a flowchart for illustrating maintenance and recovery operations in the image forming apparatus according to any one of the first, second, third and fourth embodiments.
Figure 7:
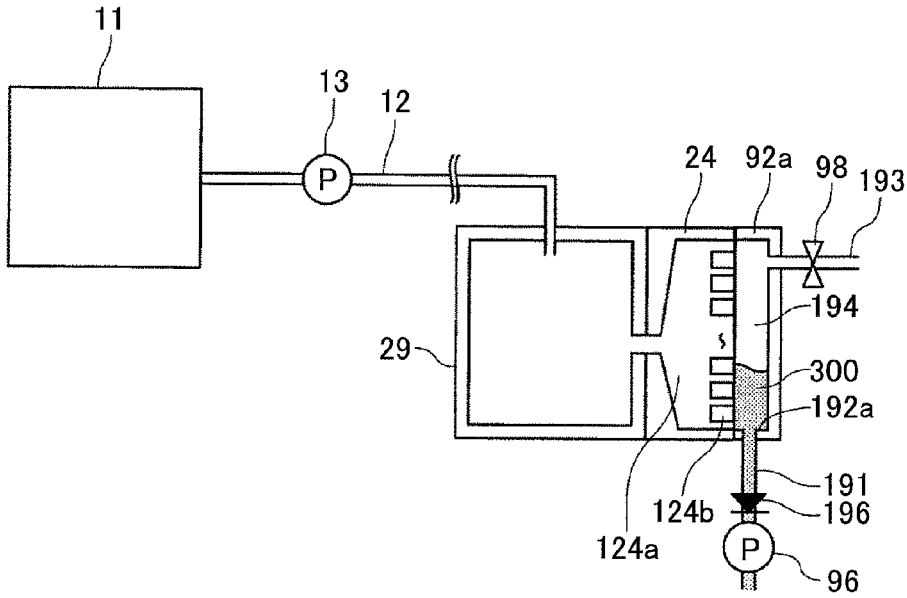
FIGS. 7 and 8 schematically illustrate the maintenance and recovery operations in the image forming apparatus according to the first embodiment of the present invention.

Next, with reference to FIG. 6 (flowchart) and also FIGS. 4, 7 and 8, the maintenance and recovery operations in the image forming apparatus 1 according to the first embodiment of the present invention will be described.

The maintenance and recovery operations are carried out in a case where clogging of the nozzles 124*b* of the recording head 24 occurs, in a case where the meniscuses of the nozzles 124*b* are broken as the negative pressure in the head tank 29 is not maintained, in predetermined timing, and so forth.

In the maintenance and recovery operations, the recording head 24 is positioned at a main scan direction position facing the suction cap 92*a*, and a cap moving mechanism (not shown) is driven so that the suction cap 92*a* is moved. Thus, the suction cap 92*a* is caused to cap the nozzle face 124 of the recording head 24 (step S1). At this time, the atmosphere opening valve 98 (see FIG. 4) is closed.

Next, the suction pump 96 is driven, and a negative pressure is created in the airtight space 194 in the suction cap 92*a* (see FIG. 4). Thereby, the ink held in the nozzles 124*b* of the recording head 24 is suctioned and discharged into the suction cap 92*a* (step S2). This operation (step S2) will be referred to as a suction operation (or nozzle suction). Thereby, as shown in FIG. 7, ink 300 is discharged into the suction cap 92*a*. Since the recording head 24 and the suction cap 92*a* are disposed to stand along the vertical direction as shown in FIG. 7, the ink 300 is being collected from the bottom surface 192*a* of the airtight space 194.

After the suction operation (step S2), the supply pump 13 is driven in the normal direction, the ink is supplied from the main tank 11 to the head tank 29 (step S3). Thereby the negative pressure in the head tank 29 and the recording head 24 is weakened, or is changed into a positive pressure. This operation (step S3) will be referred to as a pressurizing operation.

After the pressurizing operation (step S3), the atmosphere opening valve 98 is opened, and the airtight space 194 is opened to the atmosphere (step S4). At this time, the driving of the suction pump 96 is continued or is started again (step S5). Thereby, the ink 300 having been discharged into the suction cap 92*a* and remaining there is then discharged into the waste liquid tank 97 (see FIG. 2) via the discharge path 191. This operation (step S5) will be referred to as a discharge from cap operation.

After the discharge from cap operation (step S5), the supply pump 13 is driven in the reverse direction, and the ink in the head tank 29 is returned to the main tank 11 (step S6). Thereby, a required negative pressure is created in the head tank 29 and the recording head 24. This operation (step S5) will be referred to as a negative pressure creation operation.

Figure 8:
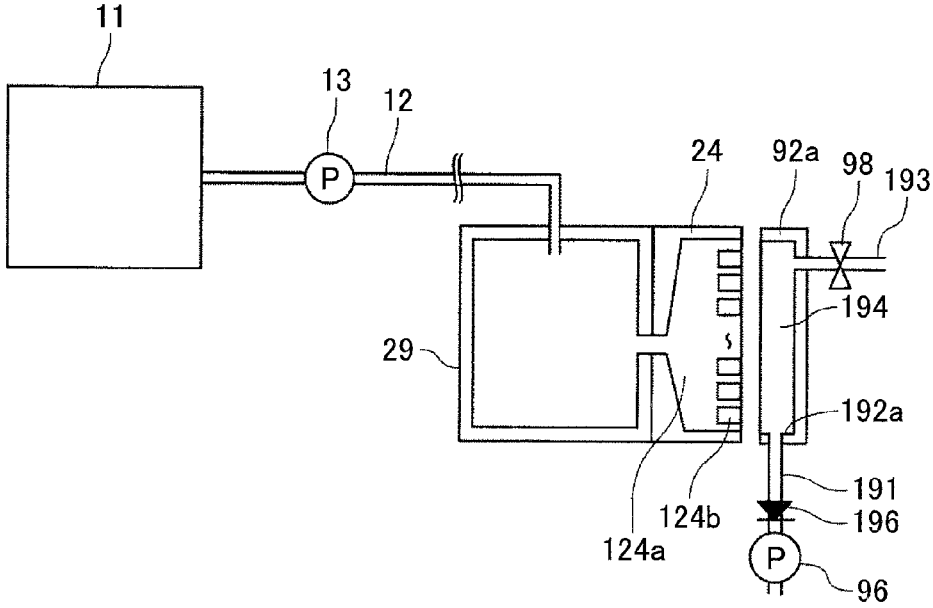

Then, the cap moving mechanism 531 is driven, and the suction cap 92*a* is separated from the nozzle face 124 of the recording head 24 as shown in FIG. 8 (step S7). This operation (step S7) will be referred to as a decapping operation. After that, the nozzle face 124 of the recording head 24 is wiped and cleaned by the wiper member 93 (step S8).

After that, a dummy discharge operation of discharging liquid droplets (not contributing to image forming) is carried out toward the dummy discharge receiver 94 (step S9).

Effects of the maintenance and recovery operations described above with reference to FIGS. 4, 6, 7 and 8 will now be described.

In the image forming apparatus 1, each recording head 24 is disposed in such a manner that the nozzle face 124 stands vertically (i.e., each of the nozzle rows Na and Nb extends vertically). Therefore, as described above with reference to FIG. 7, when the ink is suctioned from the nozzles 124*b* of the recording head 24, the thus-suctioned ink 300 remains at the bottom part of the suction cap 92*a*. Further, as mentioned above, the ink droplets having different colors are discharged from the two nozzle rows Na and Nb of each of the recording heads 24. Therefore, the remaining ink 300 in the suction cap 92*a* is in a state where the different colors are mixed.

It is noted that since the ink is thus suctioned from the nozzles 124*b* of the recording head 24 and is discharged into the suction cap 92*a*, the negative pressure in the recording head 24 and in the head tank 29 is strengthened.

Therefore, if the atmosphere opening valve 98 were opened in order to discharge the remaining ink 300 from the suction cap 92*a* where the negative pressure is strengthened, the remaining ink 300 in the suction cap 92*a* where the different colors are mixed might flow backward into the nozzles 124*b*. If so, the ink where the different colors are mixed would be discharged from the nozzles 124*b* onto the sheet of paper 10 at a time of a subsequent printing operation, and image quality might be degraded.

In this case, if decapping were carried out where the ink 300 is remaining in the suction cap 92*a* in order to avoid the flowing backward of the ink where the different colors are mixed, the ink 300 remaining in the suction cap 92*a* would drip from the suction cap 92*a* since the suction cap 92*a* faces (is open) toward a horizontal direction, and might stain the inside of the image forming apparatus 1 with the ink 300.

In order to avoid the problematic situations, according to the first embodiment of the present invention, the ink is supplied to the head tank 29 by the supply pump 13 (step S3) after the completion of the suction operation (step S2). Thereby, the negative pressure in the head tank 29 and the recording head 24 is weakened, or is changed into a positive pressure. Thereby, it is possible to prevent the ink remaining in the suction cap 92*a* from flowing backward to the nozzles 124*b*. After that, the atmosphere opening valve 98 is opened and the airtight space 194 in the suction cap 92*a* is opened to the atmosphere (step S4), and the ink remaining in the suction cap 92*a* is suctioned and discharged from the suction cap 92*a* (step S5). Thus, it is possible to prevent the ink 300 from dripping from the suction cap 92*a* when the decapping (S7) is carried out.

Next, details of the maintenance and recovery mechanism 9 according to the second embodiment of the present invention will be described with reference to FIG. 9. It is noted that a configuration of the second embodiment of the present invention may be similar to that of the first embodiment of the present invention described above with reference to FIGS. 1 through 5, or the first embodiment may be configured more specifically as the second embodiment. Therefore, the same reference numerals are given to parts corresponding to those of the first embodiment, and duplicate description therefor will be omitted as is appropriate.

Figure 9:
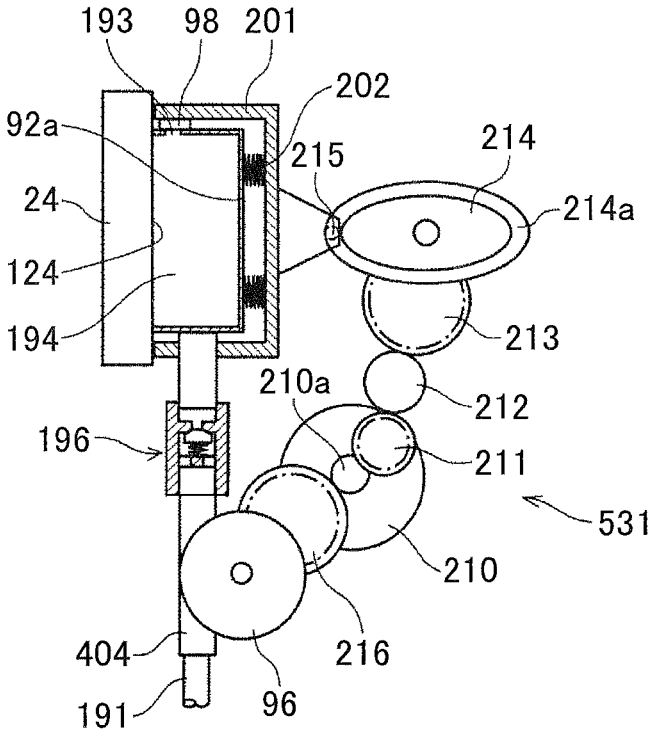
FIG. 9 schematically illustrates a maintenance and recovery mechanism in the image forming apparatus according to the second embodiment of the present invention.

In the second embodiment, as shown in FIG. 9, the suction cap 92*a* is held by a cap holder 201 via springs 202. The atmosphere opening path (i.e., an atmosphere opening hole in the second embodiment) 193 is formed at a top part of the suction cap 92*a* to open the airtight space 194 to the atmosphere. The atmosphere opening valve (i.e., a valve body in the second embodiment) 98 that opens and closes the atmosphere opening hole 193 is provided to the cap holder 201. It is noted that the atmosphere opening hole 193 of the suction cap 92*a* is opened as a result of the valve body 98 being moved together with the cap holder 201. That is, as the suction cap 92*a* is started to be separated (to retreat) from the nozzle face 124 of the recording head 24, the cap holder 201 is separated from the nozzle face 124 first, prior to the suction cap 92*a* as the springs 202 expand. Therefore, the valve body 98 provided to the cap holder 201 is removed from the atmosphere opening hole 98 as the cap holder 201 retreats from the nozzle face 124 first, prior to the suction cap 92*a*. Thus, the atmosphere opening hole 194 is opened. Thus, an atmosphere opening part (including the valve body 98 and the atmosphere opening hole 193) is opened in conjunction with the separation operation (i.e., separating from the nozzle face 124) of the suction cap 92*a*.

Figure 10B:
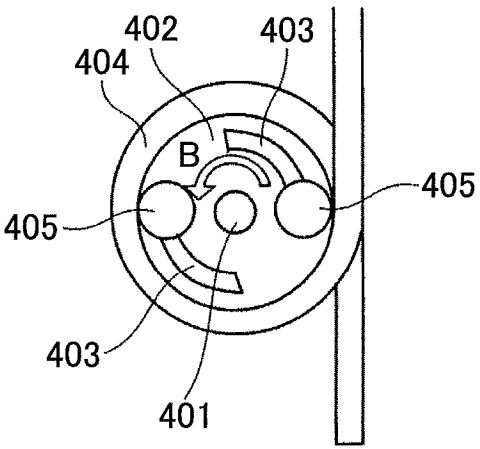
FIGS. 10A and 10B show plan views of a suction pump included in the maintenance and recovery mechanism shown in FIG. 9.
Figure 10A:
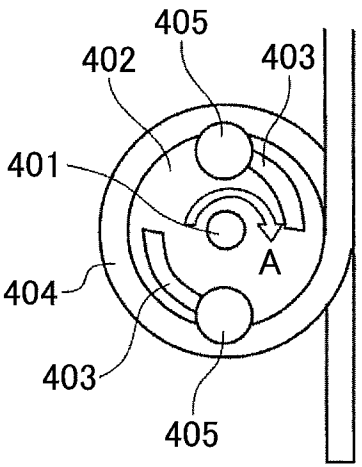

The tube pump of the suction pump 96 is configured, for example, as shown in FIGS. 10A and 10B, as follows. A cam plate 402 is fixed to a rotation shaft 401 to which driving force is transmitted from a motor (not shown). The cam plate 402 has eccentric grooves 403, and rollers 405 are engaged with the eccentric grooves 403, respectively. The rollers 405 crush a tube 404 that lies around in a pump housing (not shown). When the cam plate 402 is rotated clockwise (a direction A) as shown in FIG. 10A, the rollers 405 move outward gradually as being guided by the eccentric grooves 403, and then, the rollers 405 crush the tube 404 while sliding on the tube 404 at the same time. Thereby, the liquid held in the tube 404 is pushed to move through the tube 404 in the direction in which the rollers 405 rotate about the rotation shaft 401 together with the cam plate 402. Thus, the tube pump of FIG. 10 functions as a pump. On the other hand, when the cam plate 402 is rotated counterclockwise (a direction B), as shown in FIG. 10B, the rollers 405 move inward gradually as being guided by the eccentric grooves 403, and then, the rollers 405 stop the crushing of the tube 404.

Returning to FIG. 9, the cap moving mechanism 531 causes the suction cap 92*a* to go forward and retreat, drives the suction pump 96, and has one driving motor 210. A rotation of the driving motor 210 is transmitted to a cap cam 214 via a gear 211, a one-way clutch 212, and a driving force transmission mechanism including a gear 213. The gear 211 engages a motor gear 210*a* of the driving motor 210. The one-way clutch 212 transmits only a reverse rotation of the driving motor 210 via the gear 211 to the gear 213. The gear 213 transmits the reverse rotation of the driving motor 210 from the one-way clutch 212 to the cap cam 214. A pin member 215 connected with the cap holder 201 engages a cam groove 214*a* of the cap cam 214. Thereby, the suction cap 92*a* goes forward to and retreats from the nozzle face 214 as the cap cam 214 is rotated since the cap cam 214 has an oval shape as shown in FIG. 9. That is, as the cap cam 214 is rotated, the pin member 215 is moved in a go-and-return manner being guided by the cam groove 214*a* extending along the contour of the oval shape. As the cap holder 201 is thus driven via the pin member 215, the suction cap 92*a* is moved along with the cap holder 201 to go forward to and retreat from the nozzle face 214.

Further, a rotation of the driving motor 210 is also transmitted to the rotation shaft 401 of the suction pump 96, described above with reference to FIGS. 10A and 10B, via a gear 216 that engages the motor gear 210*a*. When the driving motor 210 is rotated in the normal direction, the cam plate 402 of the suction pump 96 is rotated in the direction A shown in FIG. 10A. Thus, the rollers 405 crush the tube 404 and at the same time slide on the tube 404 so as to function as a pump to push the liquid held by the tube 404 along the tube 404. When the driving motor 210 is rotated in the reverse direction, the cam plate 402 is rotated in the direction B shown in FIG. 10B. Thus, the rollers 405 stop the crushing of the tube 404.

Figure 11B:
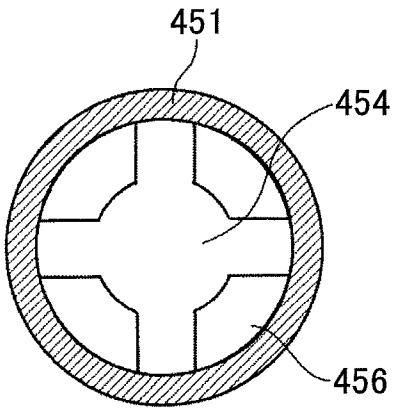
FIGS. 11A and 11B show a sectional view and a cross-sectional view, respectively, of a check valve included in the maintenance and recovery mechanism shown in FIG. 9.
Figure 11A:
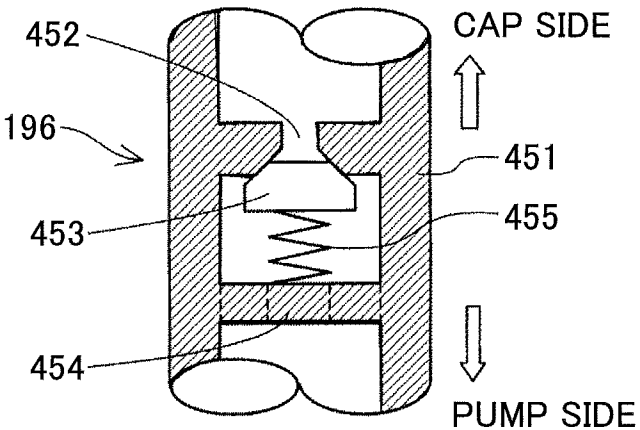

As shown in FIGS. 11A and 11B, the check valve 196 (see FIG. 9) has a valve body 453 to open and close a flow path 452 formed in a holder 451, and a spring 455 that is inserted between a spring holding part 454 and the valve body 453 and presses the valve body 453 at any time in a direction to close the flow path 452. The valve body 453 is made of a resilient material such as a rubber and is thus capable of ensuring sealing performance with small force. Further, a water-repellent treatment is carried out on the surface of the valve body 453 such that adhesion of the ink is prevented. It is noted that the spring holding part 454 is provided at a part in a cross-sectional area of the holder 451 to receive the spring 455 and another part acts as the flow path 452.

Next, comparison examples 1 and 2 will be described for the purpose of clarifying the advantages of the above-described first and second embodiments. It is noted that reference numerals the same as those of the first and second embodiments will be used. Also, the same as in the first and second embodiments, a driving mechanism is configured to carry out both moving a cap and driving a suction pump by driving a single driving motor in a reverse direction and a normal direction, respectively.

First, a case of the vertical discharge system in which a nozzle face is disposed to extend horizontally as the comparison example 1 will be described with reference to FIGS. 12A, 12B, 12C, 12D, 12E, 13A, 13B and 13C.

Figure 12A:
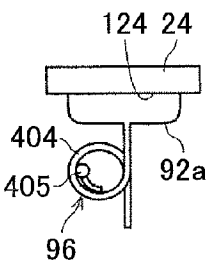
FIGS. 12A, 12B, 12C, 12D and 12E schematically illustrate a comparison example 1.
Figure 12B:
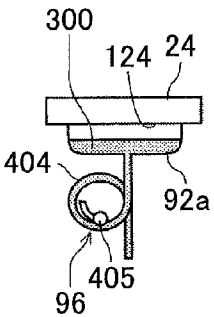

As shown in FIG. 12A (concerning "capping"), the driving motor (not shown) is driven in the reverse direction, and the cap 92*a* is caused to cap the nozzle face 124 of the recording head 24 (where the roller 405 of the suction pump 96 is in a state of not crushing the tube 404). Then, as shown in FIG. 12B (concerning "head suctioning"), the driving motor is driven in the normal direction, the suction pump 96 is thus driven (where the roller 405 crushes the tube 404) to suction ink 300 from the nozzles of the recording head 24, and discharge the suctioned ink 300 into the suction cap 92*a*.

Figure 12C:
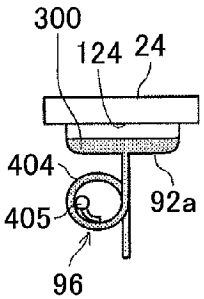
Figure 12D:
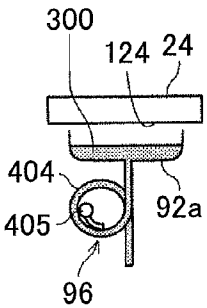
Figure 12E:
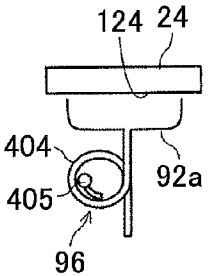

Then, as shown in FIG. 12C (concerning "negative pressure in cap weakening"), the driving motor is driven in the reverse direction, and the roller 405 of the suction pump 96 stops the crushing of the tube 404. Thereby, the inside of the suction cap 92*a* is opened to the atmosphere on the discharge side through the tube 404 (i.e., a discharge path), and thus, a negative pressure in an airtight space of the suction cap 92*a* is weakened. As a result of the driving of the driving motor in the reverse direction being continued from this state, the suction cap 92*a* is separated (decapped) from the nozzle face 124 as shown in FIG. 12D (concerning "decapping"). After that, as shown in FIG. 12E, as a result of the driving motor being driven in the normal direction, the discharged ink 300 in the suction cap 92*a* is discharged to the waste liquid tank 97 (see FIG. 2) through the suction pump 96.

Figure 13A:
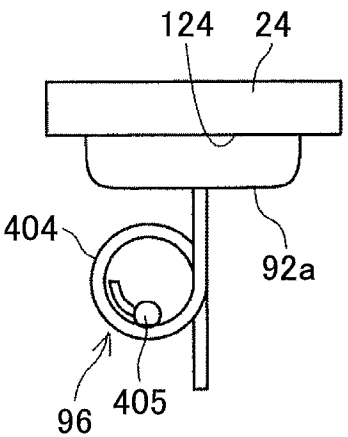
FIGS. 13A, 13B and 13C schematically illustrate generation of air bubbles in the comparison example.
Figure 13B:
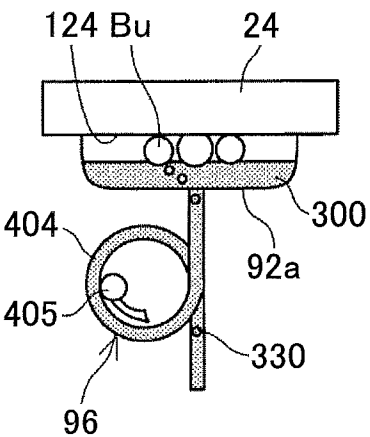
Figure 13C:
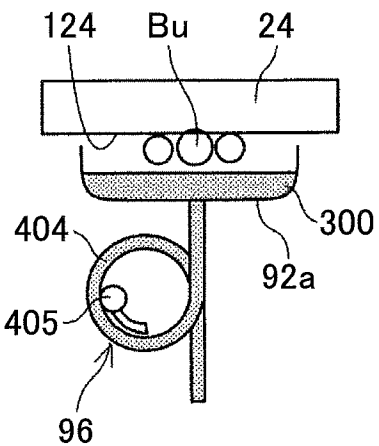

In these operations described above with reference FIGS. 12A-12E, the ink is being suctioned from the nozzles of the recording head 24 as shown in FIG. 13A. After the completion of the operation of suctioning the ink from the nozzles, the driving motor is driven in the reverse direction as mentioned above. Thus, the roller 405 of the suction pump 97 stops the crushing of the tube 404, and the negative pressure in the suction cap 92*a* is weakened through the tube 404. At this time, as shown in FIG. 13B, a flow due to pressure from the not-shown waste liquid tank (on the discharge side of the discharge path) to the suction cap 92*a* may be created, and thereby, air bubbles 330 may enter the suction cap 92*a* through the tube 404 (the discharge path). As a result, air bubbles Bu may be generated in the suction cap 92*a* in which the discharged ink 300 has been collected. Then, as shown in FIG. 13C, the air bubbles Bu generated in the suction cap 92*a* may come into contact with the nozzle face 124. If so, since the discharged ink 300 is in a state where different colors are mixed as mentioned above, the color-mixed discharged ink may enter the nozzles, or so, color mixture may occur when the ink is discharged from the nozzles onto a sheet of paper, and thus, degradation in image quality may occur.

Next, a case of the horizontal discharge system in which a nozzle face is disposed to extend vertically as the comparison example 2 will be described with reference to FIGS. 14A, 14B, 14C, 14D, 15A, 15B, 15C and 15D. It is noted that each figure schematically shows a part of the system and also shows a change in pressure in a cap.

Figure 14B:
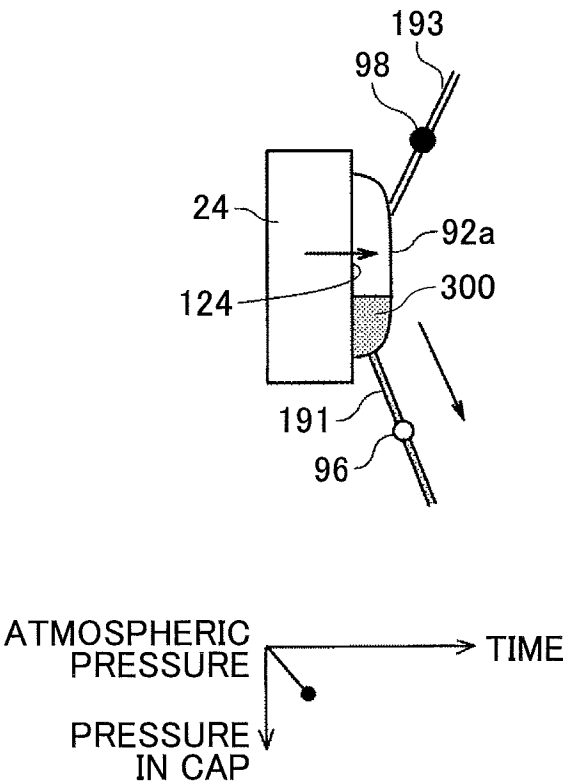
FIGS. 14A, 14B, 14C and 14D schematically illustrate a comparison example 2.
Figure 14A:
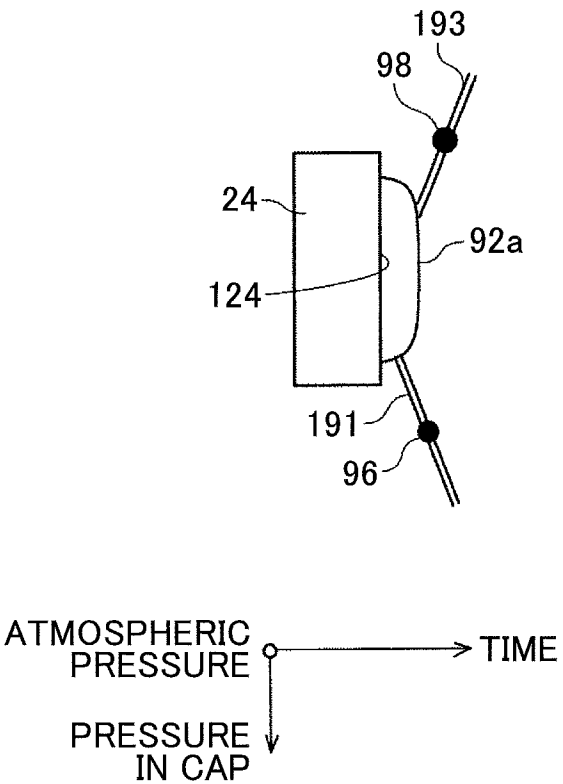
Figure 14D:
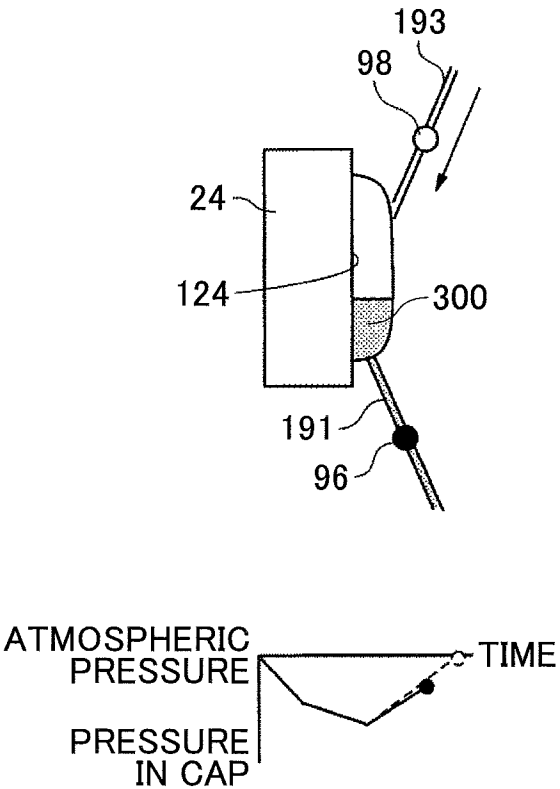
Figure 14C:
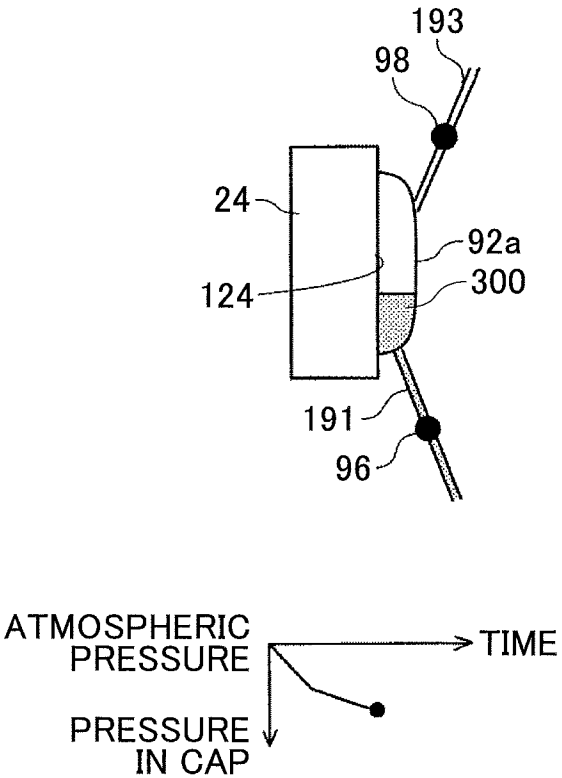

As shown in FIG. 14A, the nozzle face 124 of the recording head 24 is capped by the suction cap 92*a*. In this state, as shown in FIG. 14B (concerning "head suctioning"), the suction pump 96 is driven, and the ink 300 is suctioned from nozzles of the recording head 24 and is discharged into the suction cap 92*a*. Then, even after the suction pump 96 is stopped as shown in FIG. 14C (concerning "suction pump stopping"), the ink 300 gradually flows into the suction cap 92*a*. After that, the atmosphere opening valve 98 is opened, and the inside of the suction cap 92*a* is opened to the atmosphere, as shown in FIG. 14D. At this time, the inside of the suction cap 92*a* is not immediately returned to the atmospheric pressure.

Figure 15B:
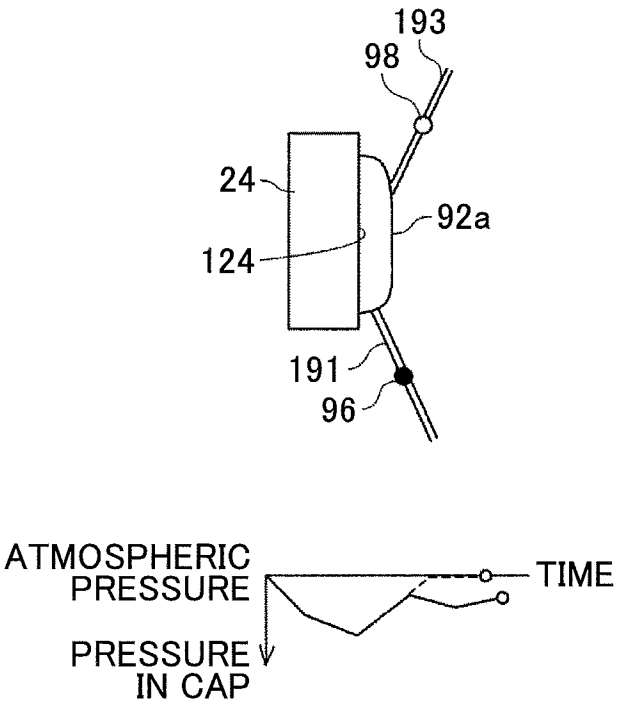
FIGS. 15A, 15B, 15C and 15D schematically illustrate generation of air bubbles in the comparison example 2.
Figure 15A:
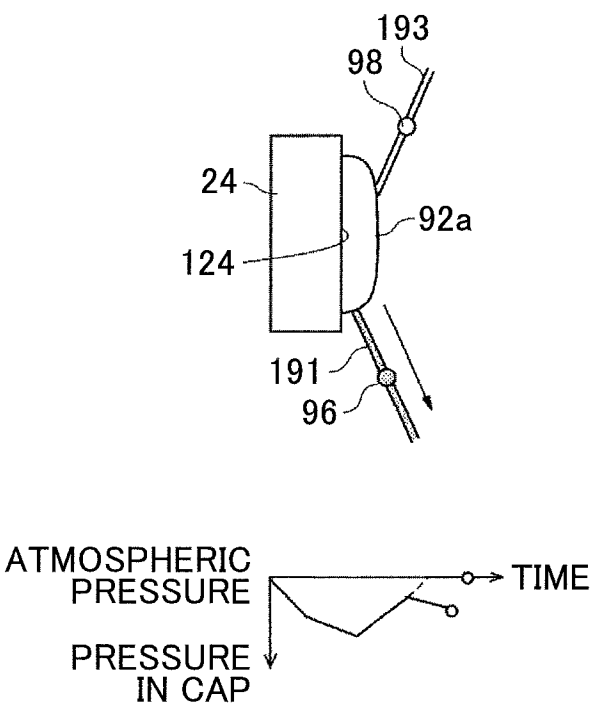
Figure 15D:
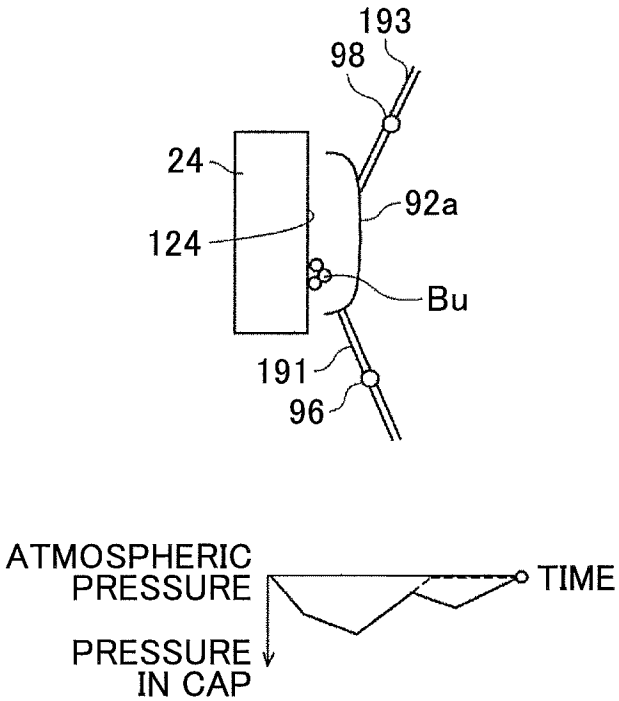
Figure 15C:
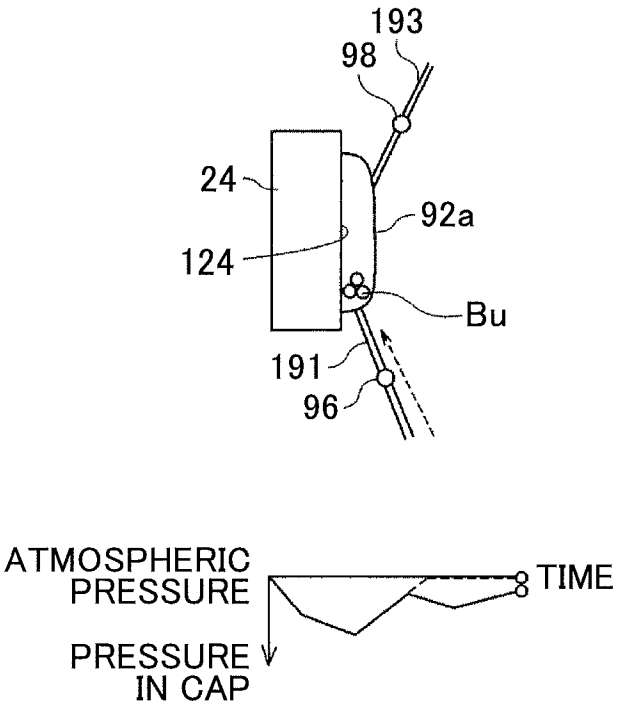

After that, as shown in FIG. 15A (concerning "cap suctioning"), the suction pump 96 is driven, and the discharged ink 300 in the suction cap 92*a* is discharged through the discharge path 191. Then, as shown in FIG. 15B (concerning "suction pump stopping"), the suction pump 96 is stopped, and, a roller (not shown) in the suction pump 96 stops crushing a tube (not shown) as shown in FIG. 15C (concerning "suction pump atmosphere opening"). Thereby, the inside of the suction cap 92*a* is opened to the atmosphere through the tube and the discharge path 191. At this time, due to the remaining negative pressure in the suction cap 92*a*, air enters through the discharge path 191, and air bubbles Bu are generated in the suction cap 92*a* (see FIG. 15C). As shown in FIG. 15D (concerning "decapping"), the air bubbles Bu move along the inner surface of the suction cap 92*a* and adhere to the nozzle face 124. After the decapping (i.e., separating the suction cap 92*a* from the nozzle face 124) is carried out as shown in FIG. 15D, the air bubbles Bu remain on the nozzle face 124. At this time, since the discharged ink 300 is in a state where different colors are mixed as mentioned above, the color-mixed discharged ink may enter the nozzles or so, as a result of the air bubbles Bu thus adhering to the nozzle face. As a result, color mixture may occur when the ink is discharged from the nozzles onto a sheet of paper, and thus, degradation in image quality may occur.

It is noted that in the above-mentioned vertical discharge system (FIGS. 12A-12E and FIG. 13A-13C), not so significant problems may occur. This is because the suction cap is disposed to extend horizontally. Therefore, when air bubbles are generated in the suction cap, the air bubbles may not come into contact with the nozzle face when the air bubbles are not so large. In contrast thereto, in the above-mentioned horizontal discharge system (FIGS. 14A-14D and FIG. 15A-15D), the suction cap is disposed to extend vertically. Therefore, air bubbles may easily move along the inner surface of the suction cap and adhere (transfer) to the nozzle face. Therefore, in comparison to the vertical discharge system, it is more necessary to control generation of air bubbles.

Operations of the maintenance and recovery mechanism 9 in the second embodiment of the present invention, described above with reference to FIGS. 9, 10A-10B and 11A-11B, will be described with reference to FIGS. 16A, 16B, 16C, 16D, 17A, 17B and 17C. It is noted that, for example, description of operations of the supply pump 13, described above with reference to FIGS. 6, 7 and 8 for the first embodiment, will not be repeated.

Figure 16B:
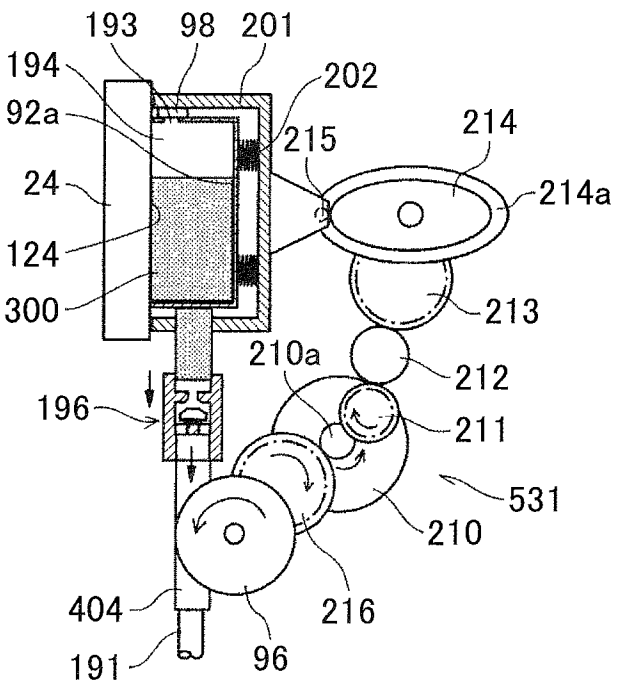
FIGS. 16A, 16B, 16C and 16D and FIGS. 17A, 17B and 17C schematically illustrate operations of the maintenance and recovery mechanism in the image forming apparatus according to the second embodiment of the present invention.
Figure 16A:
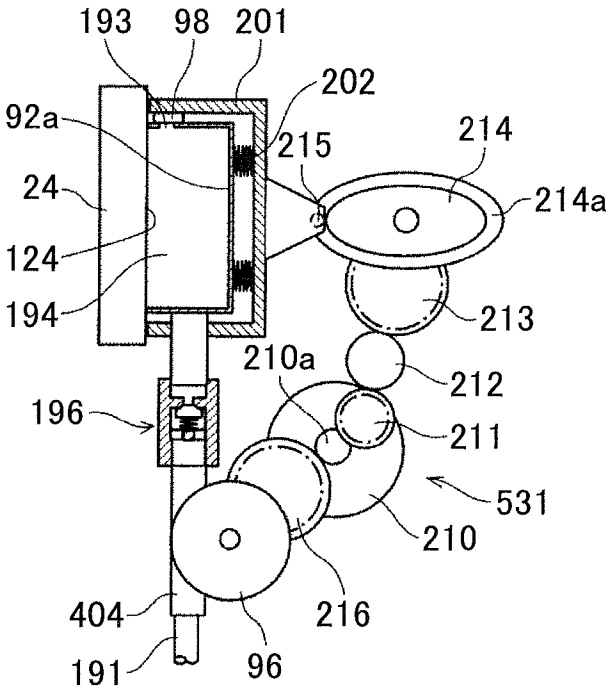
Figure 16D:
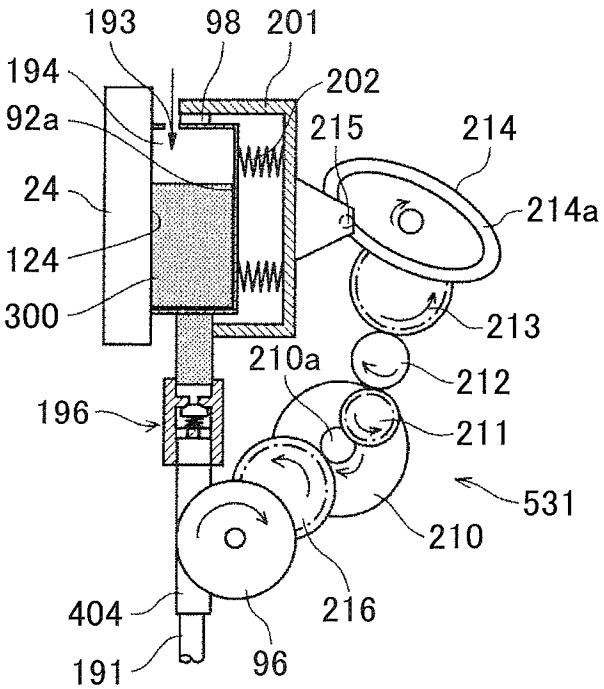
Figure 16C:
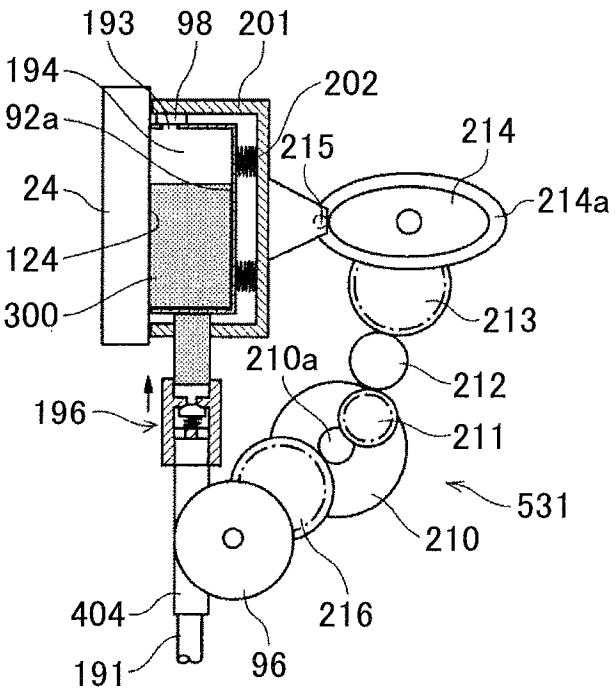

First, as shown in FIG. 16A, the nozzle face 124 of the recording head 24 is capped by the suction cap 92*a*. Then, as shown in FIG. 16B, the driving motor 210 is rotated in the normal direction and the suction pump 96 is rotated in the normal direction. At this time, the valve body 453 of the check valve 196 is moved toward the suction pump 96 against the elastic force of the spring 455, and thus opens the flow path 452. Thereby, a negative pressure is created in the suction cap 92*a* (in the airtight space 194), and ink 300 is suctioned from the nozzles of the recording head 24 and is discharged into the suction cap 92*a*. It is noted that in this case where the driving motor 210 is rotated in the normal direction, the cap cam 214 is not rotated due to the function of the one-way clutch 212. After that, the driving motor 210 is stopped, and then, as shown in FIG. 16C, since the suction force of the suction pump 96 is thus removed, the valve body 453 of the check valve 196 is returned due to the elastic force of the spring 155, and closes the flow path 452.

Then, the driving motor 210 is rotated in the reverse direction. Thereby, the cap cam 214 is rotated, the cap holder 201 thus retreats from the nozzle face 124, and the valve body 98 is moved together with the cap holder 201 prior to movement of the suction cap 92*a*. Thereby, the atmosphere opening hole 193 of the suction cap 92*a* is opened, and thus, the inside of the suction cap 92*a* is opened to the atmosphere, as shown in FIG. 16D. At this time, the rollers 405 of the suction pump 96 stop crushing the tube 404 and the tube 404 is opened. However, the check valve 196 is in the closed state as mentioned above. Therefore, if air enters the discharge path 191, the air is stopped by the check valve 196, and thus, is prevented from flowing into the suction cap 92*a*. Thus, generation of air bubbles in the suction cap 92*a* is prevented.

Figure 17B:
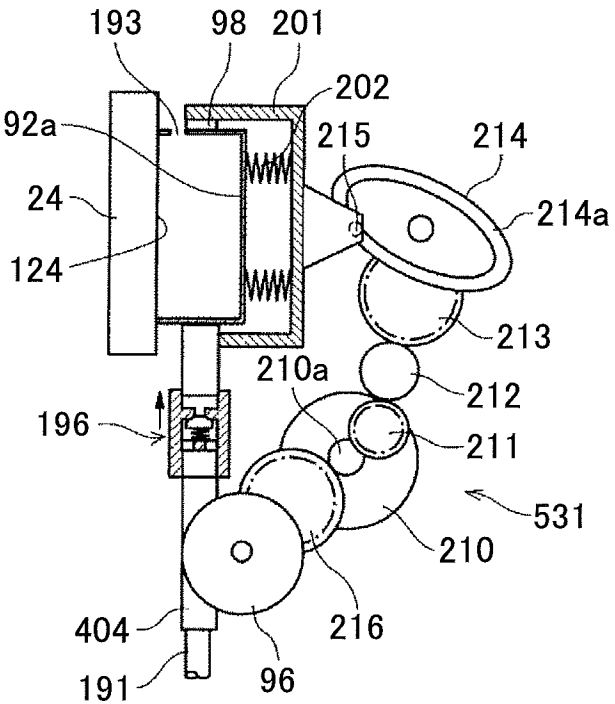
Figure 17A:
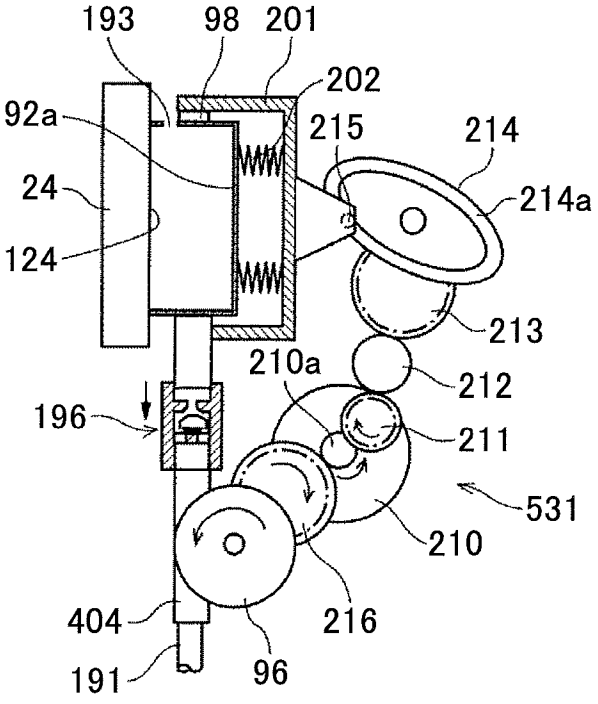
Figure 17C:
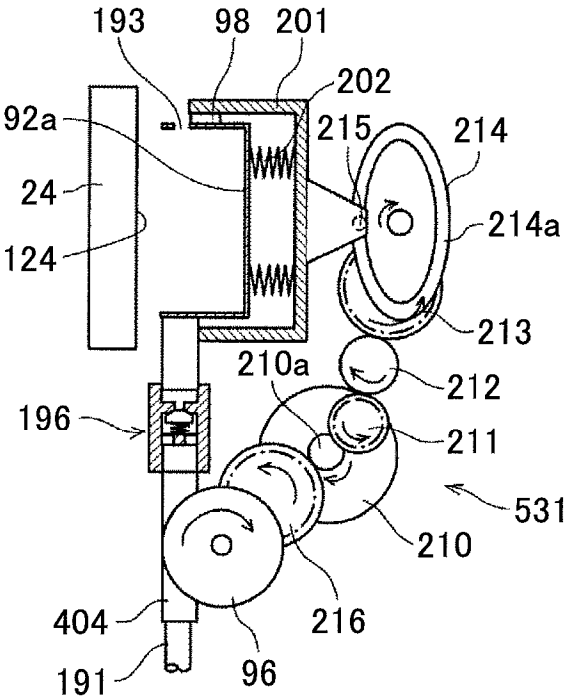

After that, as shown in FIG. 17A, the suction pump 96 is driven in the normal direction. Thereby, the check valve 196 is opened, and the ink 300 discharged into the suction cap 92*a* is then discharged into the not-shown waste liquid tank 97 via the discharge path 191. Then, the suction pump 96 is stopped, and thereby, as shown in FIG. 17B, the check valve 196 is closed. After that, as shown in FIG. 17C, the driving motor 210 is driven in the reverse direction, and the suction cap 92*a* is separated (decapped) from the nozzle face 124.

Thus, in the second embodiment of the present invention, the atmosphere opening part (including the valve body and the atmosphere opening hole) that opens the airtight space, created when the nozzle face is capped by the cap, to the atmosphere is provided. The atmosphere opening part communicates with the inside of the cap at a position higher than the height of the liquid discharged into the cap (see FIG. 16D). Further, the check valve for preventing a flow of the liquid from the suction pump toward the cap is provided in the discharge path. Thereby, it is possible to prevent generation of air bubbles, and prevent color mixture occurring due to the air bubbles, and improve image quality.

Next, details of a maintenance and recovery mechanism 9 according to the third embodiment of the present invention will be described with reference to FIGS. 18A, 18B, 18C, 18D, 19A, 19B and 19C. It is noted that, for example, description of operations of the supply pump 13, described above with reference to FIGS. 6, 7 and 8 for the first embodiment, will not be repeated.

The third embodiment is an embodiment of the present invention to which the vertical discharge system is applied where a suction cap 92*a* is disposed to extend along a horizontal direction and an opening of the suction cap 92*a* faces upward. The rest of the configuration is similar to that of the second embodiment described above, and the duplicate descriptions will be omitted, as is appropriate, with the same reference numerals given to the corresponding parts.

Figure 18A:
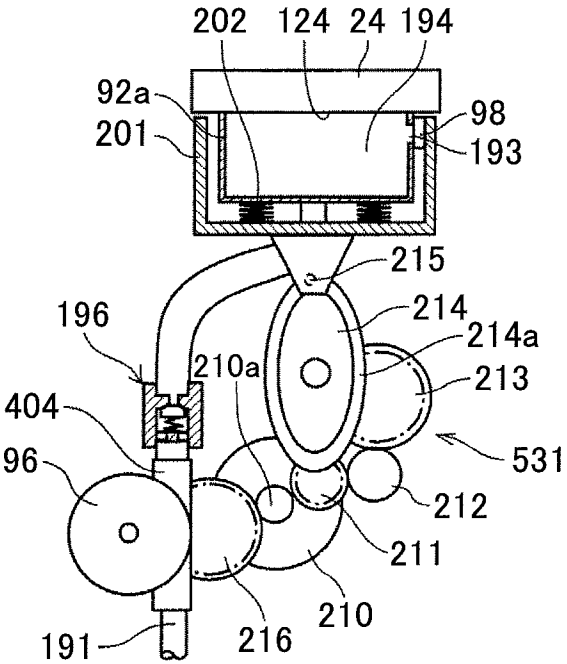
FIGS. 18A, 18B, 18C and 18D and FIGS. 19A, 19B and 19C schematically illustrate operations of a maintenance and recovery mechanism in the image forming apparatus according to the third embodiment of the present invention.
Figure 18C:
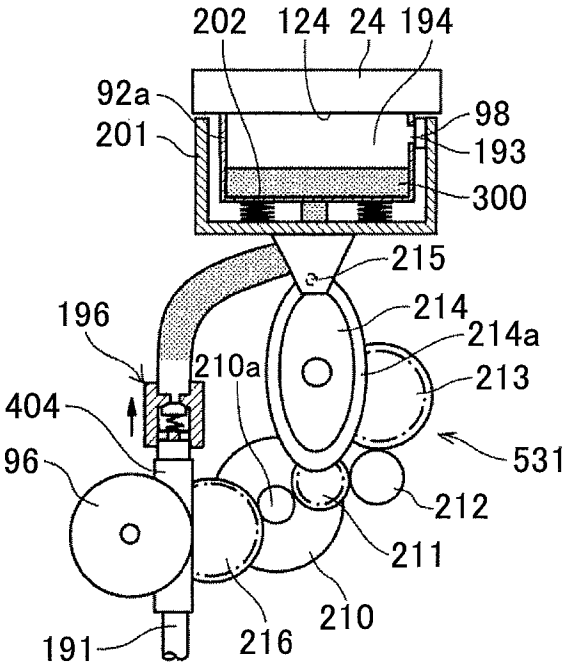
Figure 18B:
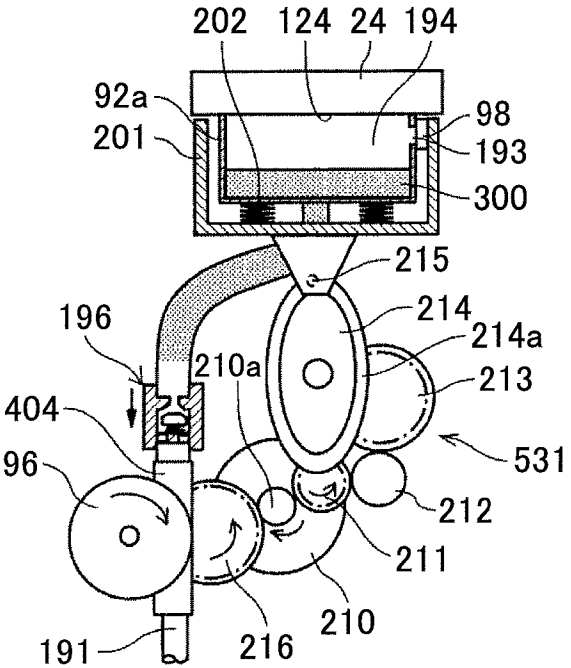

Also in the third embodiment, first, as shown in FIG. 18A, a nozzle face 124 of a recording head 24 is capped by a suction cap 92*a*. Then, as shown in FIG. 18B, the driving motor 210 is rotated in a normal direction, and a suction pump 96 is rotated in the normal direction. At this time, a valve body 453 of a check valve 196 is moved toward the suction pump 96 against elastic force of a spring 455 and thus opens a flow path 452. Therefore, a negative pressure is created in the suction cap 92*a* (in the airtight space 194), and ink 300 is suctioned from the nozzles of the recording head 24 and is discharged into the suction cap 92*a*. It is noted that in this case where the driving motor 210 is rotated in the normal direction, a cap cam 214 is not rotated due to the function of a one-way clutch 212. After that, the driving motor 210 is stopped, and then, as shown in FIG. 18C, since the suction force of the suction pump 96 is thus removed, the valve body 453 of the check valve 196 is returned due to the elastic force of the spring 155, and closes the flow path 452.

Figure 18D:
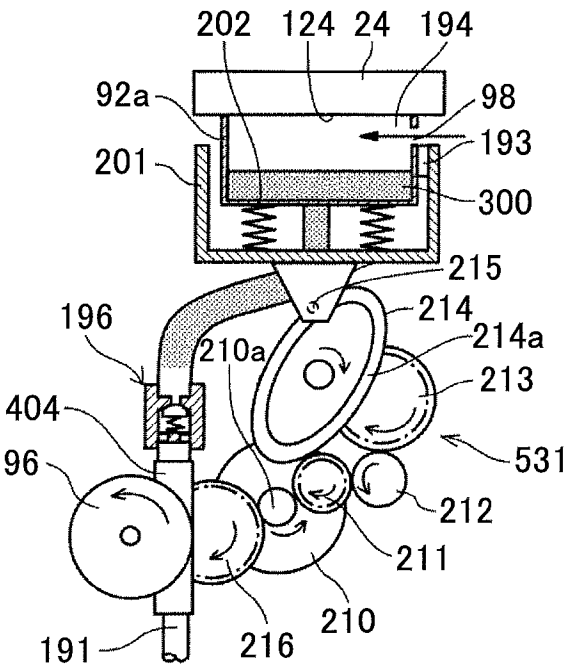

Then, the driving motor 210 is rotated in the reverse direction. Thereby, the cap cam 214 is rotated, a cap holder 201 thus retreats from the nozzle face 124 prior to the suction cap 92*a*, and a valve body 98 is moved together with the cap holder 201. Therefore, an atmosphere opening hole 193 of the suction cap 92*a* is opened, and thus, the inside of the suction cap 92*a* is opened to the atmosphere, as shown in FIG. 18D. At this time, rollers 405 of the suction pump 96 stop crushing a tube 404 and the tube 404 is opened. However, the check valve 196 is in the closed state as mentioned above. Therefore, if air enters a discharge path 191, the air is stopped by the check valve 196, and thus, is prevented from flowing into the suction cap 92*a*. Thus, generation of air bubbles in the suction cap 92*a* is prevented.

Figure 19A:
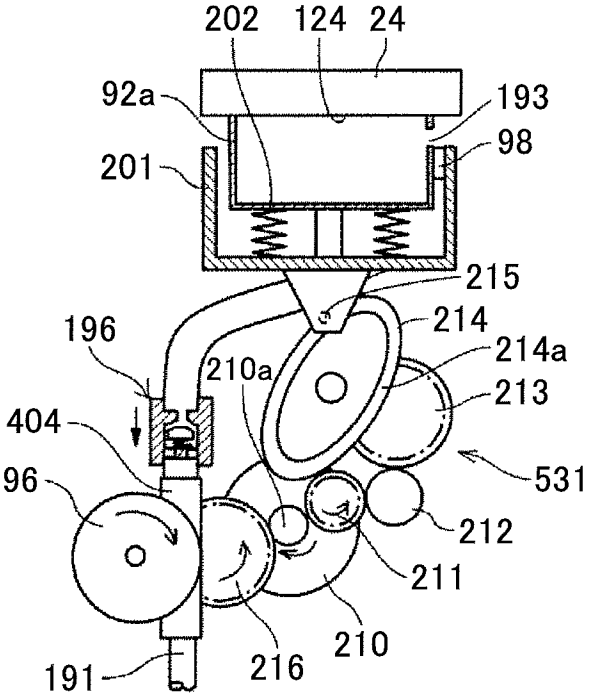
Figure 19C:
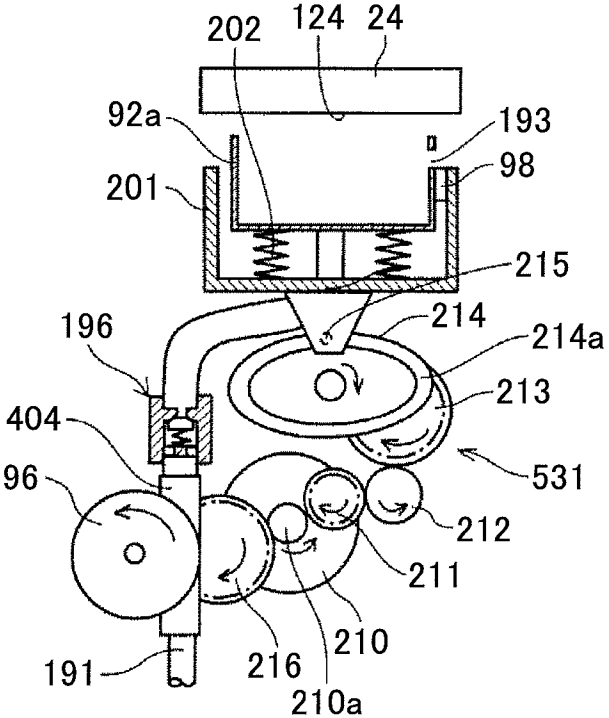
Figure 19B:
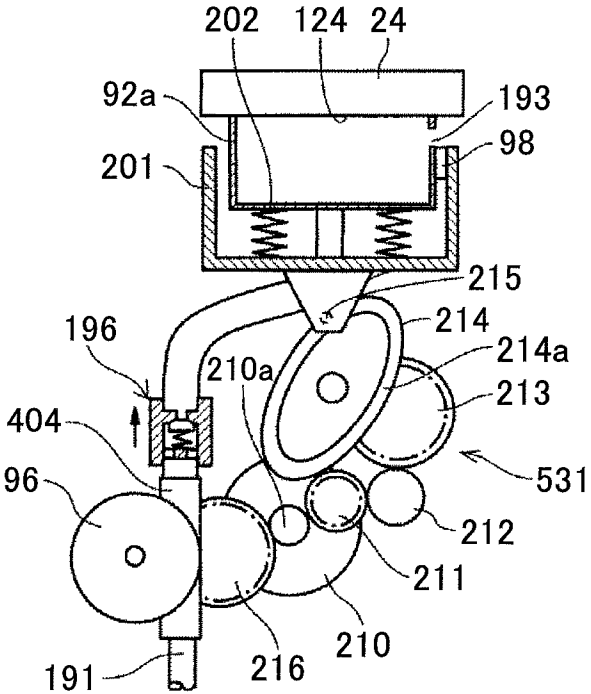

After that, as shown in FIG. 19A, the suction pump 96 is driven in the normal direction. Thereby, the check valve 196 is opened, and the ink 300 discharged into the suction cap 92*a* is then discharged into a not-shown waste liquid tank 97 via the discharge path 191. Then, the suction pump 96 is stopped, and thereby, as shown in FIG. 19B, the check valve 196 is closed. After that, as shown in FIG. 19C, the driving motor 210 is driven in the reverse direction, and the suction cap 92*a* is separated (decapped) from the nozzle face 124.

Thus, also in the case where the vertical discharge system is applied (the third embodiment), it is possible to prevent generation of air bubbles, and prevent color mixture occurring due to the air bubbles, and improve image quality.

It is noted that in the above-mentioned first and second embodiments of the present invention, the sheet of paper is conveyed along the vertical direction, and liquid droplets are discharged in the horizontal direction. As mentioned above, for example, the direction inclined from the horizontal direction may fall within an angle range between an oblique direction inclined 45° downward from the horizontal direction to an oblique direction inclined 45° upward from the horizontal direction, and any direction falling within the angle range (total 90°) may be referred to as a "horizontal direction". Similarly, the direction inclined from the vertical direction may fall within an angle range between an oblique direction inclined 45° to one side from the vertical direction to an oblique direction inclined 45° to the opposite side from the vertical direction, and any direction falling within the angle range (total 90°) may be referred to as a "vertical direction". Thus, it is also possible to apply the present invention to a configuration where a sheet of paper is conveyed along a direction inclined from the vertical direction, and liquid droplets are discharged in a direction inclined from the horizontal direction, as will be described below.

Figure 20:
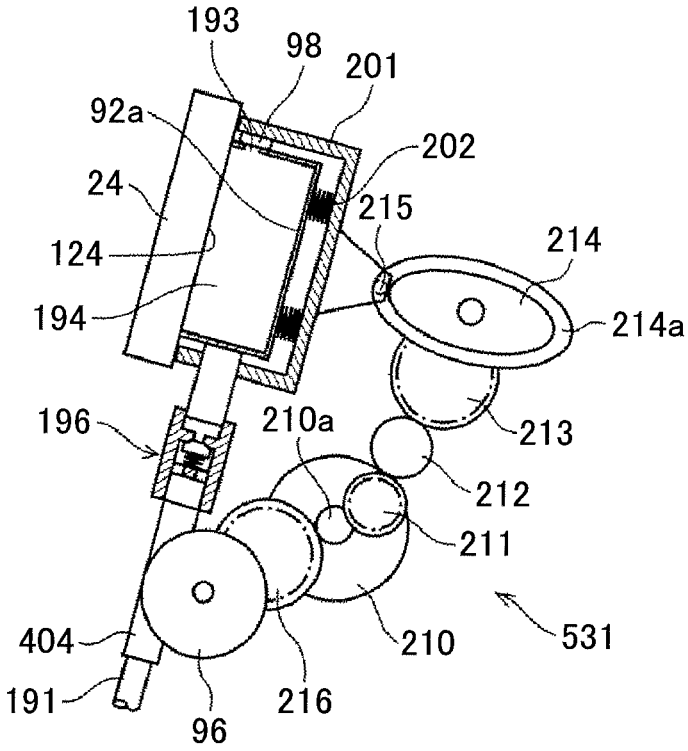
FIG. 20 schematically illustrates a maintenance and recovery mechanism in the image forming apparatus according to the fourth embodiment of the present invention.

FIG. 20 schematically illustrates a maintenance and recovery mechanism according to a fourth embodiment of the present invention. A configuration and operations of an image forming apparatus according to the fourth embodiment of the present invention are the same as those of the image forming apparatus according to the second embodiment of the present invention described above, except that, as shown in FIG. 20, a recording head 24 is disposed to extend in a direction inclined from the vertical direction, which discharges liquid droplets in a direction inclined from the horizontal direction. In FIG. 20, the same reference numerals as those of the second embodiment are given to the corresponding parts, and duplicate description therefor will be omitted. It is noted that FIG. 20 corresponds to FIG. 9 described above for the second embodiment, and the recording head 24, the suction cap 92*a* and the associated parts shown in FIG. 9 are inclined together in the configuration of FIG. 20 as shown. Other than this point, the image forming apparatus according to the fourth embodiment may be configured the same as the image forming apparatus according to the second embodiment.

Further, although the above-mentioned embodiments have been described assuming that the image forming apparatuses are the serial-type image forming apparatuses, the present invention can also be applied to line-type image forming apparatuses in a similar way.

The present invention is not limited to the specifically disclosed embodiments, and variations and modifications may be made without departing from the scope of the present invention.

The present application is based on Japanese Priority Patent Application No. 2010-197230, filed on Sep. 3, 2010, the entire contents of which are hereby incorporated herein by reference.

What is claimed is:

1. An image forming apparatus comprising:

a recording head configured to have a nozzle face on which nozzles that discharge liquid droplets are formed;

a cap configured to cap the nozzle face of the recording head;

a discharge path configured to be connected to the cap;

a suction pump configured to be provided in the discharge path and be made of a tube pump; and an atmosphere opening part configured to open an airtight space, created when the nozzle face is capped by the cap, to the atmosphere, wherein the atmosphere opening part is configured to communicate with the inside of the cap at a position higher than a surface of liquid discharged into the cap, and a check valve configured to prevent a flow of the liquid toward the cap from the suction pump is provided in the discharge path.

2. The image forming apparatus as claimed in claim 1, wherein the recording head is disposed in such a manner that the nozzle face extends along a vertical direction or a direction inclined from the vertical direction, and the recording head discharges the liquid droplets in a horizontal direction or a direction inclined from the horizontal direction.

3. The image forming apparatus as claimed in claim 1, wherein the check valve is provided between the suction pump and the cap.

4. The image forming apparatus as claimed in claim 1, wherein the atmosphere opening part is configured to open the airtight space to the atmosphere in conjunction with an operation of the cap being separated from the nozzle face.

5. A method of suctioning liquid from nozzles of a recording head configured to have a nozzle face on which the nozzles that discharge liquid droplets are formed in an image forming apparatus, the method comprising:

capping the nozzle face of the recording head by a cap;

suctioning the liquid from the nozzles of the recording head by a suction pump provided in a discharge path and discharging the suctioned liquid into the cap;

pressurizing an airtight space that is created when the nozzle face is capped by the cap, by driving a supply pump to supply the liquid to a head tank that supplies the ink to the recording head;

opening the airtight space to the atmosphere by an atmosphere opening part, wherein the atmosphere opening part communicates with the inside of the cap at a position higher than a surface of the liquid discharged into the cap; and discharging the liquid, once discharged into the cap, from the cap through the discharge path by the suction pump.

6. A non-transitory computer readable information recording medium storing a program which, when executed by one or plural computer processors, performs a method of suctioning liquid from nozzles of a recording head configured to have a nozzle face on which the nozzles that discharge liquid droplets are formed in an image forming apparatus, the method comprising:

capping the nozzle face of the recording head by a cap;

suctioning the liquid from the nozzles of the recording head by a suction pump provided in a discharge path and discharging the suctioned liquid into the cap;

pressurizing an airtight space that is created when the nozzle face is capped by the cap, by driving a supply pump to supply the liquid to a head tank that supplies the ink to the recording head;

opening the airtight space to the atmosphere by an atmosphere opening part, wherein the atmosphere opening part communicates with the inside of the cap at a position higher than a surface of the liquid discharged into the cap; and discharging the liquid, once discharged into the cap, from the cap through the discharge path by the suction pump.

* * * * *